US006800846B2

(12) United States Patent
Bateman et al.

(10) Patent No.: US 6,800,846 B2
(45) Date of Patent: Oct. 5, 2004

(54) MASS SPECTROMETER

(75) Inventors: Robert Harold Bateman, Knutsford (GB); Kevin Giles, Altrincham (GB); Steve Pringle, Hoddlesden (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/448,058

(22) Filed: May 30, 2003

(65) Prior Publication Data

US 2004/0026612 A1 Feb. 12, 2004

Related U.S. Application Data

(60) Provisional application No. 60/422,087, filed on Oct. 30, 2002.

(30) Foreign Application Priority Data

May 30, 2002 (GB) ..... 0212511
Apr. 11, 2003 (GB) ..... 0308346

(51) Int. Cl.[7] ..... H01J 49/00

(52) U.S. Cl. ..... 250/281; 250/286; 250/287; 250/282; 250/290; 250/292

(58) Field of Search ..... 250/287, 281, 250/286, 282, 290, 292

(56) References Cited

U.S. PATENT DOCUMENTS

| | | | | |
|---|---|---|---|---|
| 5,140,158 A | * | 8/1992 | Post | 250/281 |
| 5,206,506 A | | 4/1993 | Kirchner | |
| 5,572,035 A | | 11/1996 | Franzen | |
| 5,789,745 A | * | 8/1998 | Martin et al. | 250/286 |
| 5,811,800 A | | 9/1998 | Franzen et al. | |

(List continued on next page.)

FOREIGN PATENT DOCUMENTS

| | | |
|---|---|---|
| CA | 2281405 | 3/2000 |
| EP | 0 290 712 | 11/1988 |
| EP | 1 271 610 | 1/2003 |
| GB | 2 242 309 | 9/1991 |
| GB | 2 242 311 | 9/1991 |
| GB | 2 242 316 | 9/1991 |
| GB | 2 375 653 | 11/2002 |
| JP | 11-307040 | 11/1999 |
| JP | 2000-113852 | 4/2000 |
| JP | 2000-123780 | 4/2000 |
| WO | 94/01883 | 1/1994 |
| WO | WO 97/07530 | 2/1997 |
| WO | WO 97/49111 | 12/1997 |
| WO | WO 02/43105 | 5/2002 |

OTHER PUBLICATIONS

Teloy et al., "Integral Cross Sections For Ion–Molecule Reactions. I. The Guided Beam Technique", Chemical Physics, vol. 4, pp. 417–427, 1974.

Gerlich et al., "Ion Trap Studies of Association Processes in Collisions of $CH^{+3}$ and $CD^{+3}$ With n–$H_2$, p–$H_2$, $D_2$,and He at 80 K", The Astrophysical Journal, vol. 347, No. 2, pp. 849–854, 1989.

Guan et al., "Stacked–Ring Electrostatic Ion Guide", J. Am. Soc. for Mass Spectrometry, vol. 7, pp. 101–106, 1996.

Franzen et al., "Electrical Ion Guides", ASMS Book of Abstracts, pp. 1170, 1996.

(List continued on next page.)

*Primary Examiner*—Nikita Wells
*Assistant Examiner*—James J. Leybourne
(74) *Attorney, Agent, or Firm*—Diederiks & Whitelaw, PLC

(57) ABSTRACT

A mass spectrometer is disclosed comprising a gas collision cell, reaction cell or collisional cooling cell comprising a plurality of electrodes. DC potentials are progressively applied to the cell so that ions are urged along the cell.

82 Claims, 13 Drawing Sheets

U.S. PATENT DOCUMENTS

| | | | |
|---|---|---|---|
| 5,818,055 | A | 10/1998 | Franzen |
| 5,847,386 | A | 12/1998 | Thomson et al. |
| 5,905,258 | A | 5/1999 | Clemmer et al. |
| 6,107,628 | A | 8/2000 | Smith et al. |
| 6,111,250 | A | 8/2000 | Thomson et al. |
| 6,403,953 | B2 | 6/2002 | Whitehouse et al. |
| 6,417,511 | B1 | 7/2002 | Russ, IV et al. |
| 6,462,338 | B1 | 10/2002 | Inatsugu et al. |
| 6,489,610 | B1 | 12/2002 | Barofsky et al. |
| 6,545,268 | B1 | 4/2003 | Verentchikov et al. |
| 6,559,444 | B2 | 5/2003 | Franzen |
| 6,693,276 | B2 | 2/2004 | Weiss et al. |
| 2001/0032939 | A1 | 10/2001 | Fuhrer et al. |
| 2002/0063207 | A1 | 5/2002 | Bateman et al. |
| 2002/0063209 | A1 | 5/2002 | Bateman et al. |
| 2002/0063210 | A1 | 5/2002 | Bateman et al. |
| 2002/0070338 | A1 | 6/2002 | Loboda |
| 2002/0079443 | A1 | 6/2002 | Krutchinsky et al. |
| 2002/0113207 | A1 | 8/2002 | Lee et al. |
| 2002/0121597 | A1 | 9/2002 | Tanner et al. |
| 2002/0148959 | A1 | 10/2002 | Weiss et al. |
| 2004/0041090 | A1 | 3/2004 | Bloomfield et al. |

OTHER PUBLICATIONS

Shaffer et al., "A Novel Ion Funnel for Ion Focusing at Elevated Pressures ", ASMS Book of Abstracts, pp. 375, 1997.

Shaffer et al., "A Novel Ion Funnel for Focusing Ions at Elevated Pressure Using Electrospray Ionization Mass Spectrometry", Rapid Communications in Mass Spectrometry, vol. 11, pp. 1813–1817, 1997.

Shaffer et al., "An Ion Funnel Interface for Improved Ion Focusing and Sensitivity Using Electrospray Ionization Mass Spectrometry", Analytical Chemistry, vol. 70, pp. 4111–4119, 1998.

Shaffer et al., "Characterization of an Improved Electrodynamic Ion Funnel Interface for Electrospray Ionization Mass Spectrometry", Analytical Chemistry, vol. 71, pp. 2957–2964, 1999.

Tolmachev et al., "Charge Capacity Limitations of Radio Frequency Ion Guides in Their Use for Improved Ion Accumulation and Trapping in Mass Spectrometry", Analytical Chemistry, vol. 72, pp. 970–978, 2000.

Kim et al., "Design and Implementation of a New Electrodynamic Ion Funnel", Analytical Chemistry, vol. 72, pp. 2247–2255, 2000.

Luca et al., "On the Combination of a Linear Field Free Trap With a Time–Of–Flight Mass Spectrometer", Review of Scientific Instruments, vol. 72, No. 7, pp. 2900–2908, 2001.

Giles et al., "Evaluation of a Stacked–Ring Radio Frequency Ion Transmission Device at Intermediate Pressures", ASMS, 2001.

Gerlich, "Inhomogeneous RF Fields: A Versatile Tool For the Study of Processes With Slow Ions", Adv. In Chem. Phys. Ser., vol. 82, Ch. 1, pp. 1–176, 1992.

Gerlich, "Rf Ion Guides", Encyclopedia of Mass Spectrometry, vol. 5, Chemistry and Physics of Gas–Phase Ions, pp. 1–34, 2003.

Masuda et al., "Separation of Small Particles Suspended in Liquid by Nonuniform Traveling Field", IEEE Transactions on Industry Applications, vol. 1A–23, No. 3, pp. 474–480, 1987.

Masuda et al., "Characteristics of Standing–Wave, Ring–Type Electric Curtain. Experimental Study", Electrical Engineering In Japan, vol. 93, No. 1, pp. 78–83, 1973.

Masuda et al., "Approximation For Calculating Nonuniform Traveling Fields", Electical Engineering in Japan, vol. 96, No. 5, pp. 25–31, 1976.

Masuda, "Approximate Methods For Calculating a Non–Uniform Travelling Field", Journal of Electrostatics, vol. 1, pp. 351–370, 1975.

Hu et al., "Design of Traveling–Wave Field Panel for Pharmaceutical Powders Based on Computer Simulation of Particle Trajectories", IEEE Transactions on Industry Applications, vol. 33, No. 3, pp. 641–650, 1997.

Alexander et al., "Transmission Characteristics of a Radio–Frequency–Only Quadrupole Gas–Collision Cell at High Axial Energies in a Hybrid Tandem Mass Spectrometer", Rapid Communications in Mass Spectrometry, vol. 3, No. 10, pp. 364–372, 1989.

Morris et al., "Characterization of a High–Pressure Quadrupole Collision Cell for Low–Energy Collision–Induced Dissociation", J. of Am. Soc. Of Mass Spectrometry, vol. 5, pp. 1042–1063, 1994.

Dodonov et al., "A New Technique for Decomposition of Selected Ions in Molecule Ion Reactor Coupled With Ortho–Time–Of–Flight Mass Spectrometry", Rapid Communications in Mass Spectrometry, vol. 11, pp. 1649–1656, 1997.

Wong et al., "Development of a Totally Computer–Controlled Triple Quadrupole Mass Spectrometer System", Review of Scientific Instruments, vol. 54, pp. 996–1004, 1983.

Beaugrand et al., "Ion Kinetic Energy Measurement in a Tandem Quadrupole Mass Spectrometer", ASMS Book of Abstracts, pp. 209–210, 1987.

Bartlett et al., "Product Ion Nodes in MS/MS", Instrumentation Science and Technology, vol. 22, pp. 301–312, 1994.

Cowen et al., "The Importance of High Impact Parameter Interactions in the Collision Induced Dissociation of Protonated Water Clusters By Argon Using a Wien Velocity Filter", Journal of Chemical Physics, vol. 99, No. 5, pp. 3480–3487, 1993.

Javahery et al., "A Segmented Radiofrequency–Only Quadrupole Collision Cell for Measurements of Ion Collision Cross Section on a Triple Quadrupole Mass Spectrometer", Journal of the Am. Soc. For Mass Spectrometry, vol. 8, pp. 688–696, 1997.

Loboda et al., "Novel Linac II Electrode Geometry for Creating an Axial Field in a Multipole Ion Guide", European Journal of Mass Spectrometry, vol. 6, pp. 531–563, 2000.

* cited by examiner

A
B
INTENSITY (%)
100
0
m/z
456.7
457.7
499.9
498.6
491.4
486.0
477.7
466.9
463.7
461.3
459.1
458.5
456.6
456.5
456.0
452.6
451.4
450.3
445.6
442.0
439.9
429.6
421.8
410.8
405.9
401.1

MASS SPECTROMETER

CROSS-REFERENCE TO RELATED APPLICATIONS

This application claims the benefit of the filing of U.S. Provisional Patent Application Ser. No. 60/422,087 filed Oct. 30, 2002.

BACKGROUND OF THE INVENTION

1. Field of the Invention

The present invention relates to a mass spectrometer and a method of mass spectrometry.

2. Discussion of the Prior Art

A known collision cell comprises a plurality of electrodes with an RF voltage applied between neighbouring electrodes so that ions are radially confined within the collision cell. Ions are arranged to enter the collision cell with energies typically in the range 10–1000 eV and undergo multiple collisions with gas molecules within the collision cell. These collisions cause the ions to fragment or decompose.

Gas reaction cells are also similarly known wherein ions are arranged to enter the reaction cell with energies typically in the range 0.1–10 eV. The ions undergo collisions with gas molecules but instead of fragmenting the ions tend to react with the gas molecules forming product ions.

When an ion collides with a gas molecule it may get scattered and lose kinetic energy. However, the ion is not lost from the collision cell since it is radially confined within the collision cell by the applied RF voltage. If an ion undergoes a large number of collisions, perhaps more than 100 collisions, then the ion will effectively lose all its forward kinetic energy. Such ions will now have a mean energy substantially equal to that of the surrounding gas molecules i.e. they will have become thermalized. The thermalized ions will now appear to move randomly within the gas due to continuing random collisions with gas molecules. Some ions may therefore be expected to remain within the collision cell for a relatively long period of time.

In practice ions are nonetheless observed to exit the collision cell after some delay. It is generally thought that ions continue to move relatively slowly forwards through the collision cell due to the bulk movement of gas which effectively forces ions through the collision cell. It is also thought that space charge effects caused by the continual ingress of ions into the collision cell also act to force ions through the collision cell. Ions within the collision cell therefore experience electrostatic repulsion from ions arriving from behind and this effectively pushes the ions through the collision cell.

As will be appreciated from the above, ion transit times through known RF collision and reaction cells can be relatively long due to ions losing their forward kinetic energy through multiple collisions with the collision gas. The continued presence or absence of an incoming ion beam and any surface charging leading to axial potential barriers can further adversely affect the transit time.

A relatively long ion transit time through a collision cell can significantly affect the performance of a mass spectrometer. For example, ions are required to have a relatively fast transit time through a collision cell when performing Multiple Reaction Monitoring (MRM) experiments using a triple quadrupole mass spectrometer. A fast transit time is also required when rapidly switching to different product ion spectra acquisitions using a hybrid quadrupole—Time of Flight mass spectrometer. When a mass spectrometer switches rapidly between various different parent ions, then if the resultant fragment ions formed within the collision cell exit the collision cell relatively slowly then significant quantities of fragment ions may still be present in the subsequent acquisition. This therefore causes a memory effect or crosstalk.

A known method of reducing crosstalk is to reduce the RF voltage to a low enough level in the period between measurements so that ions are no longer confined within the collision cell and consequently leak away. However, it takes a certain amount of time for the collision cell to re-fill with ions after the RF voltage has been reduced and hence if short inter-acquisition times are desired then the collision cell may not be sufficiently full before the next acquisition commences. This has the effect of reducing sensitivity which becomes more acute at shorter acquisition times.

Another situation where ions need to be rapidly transmitted through the collision cell is when a mass spectrometer is operated in a parent ion scanning mode. According to this made of operation only a specific fragment ion is set to be transmitted by a mass filter downstream of a collision cell of a tandem mass spectrometer (e.g. a triple quadrupole mass spectrometer) whilst a mass analyser upstream of the collision cell is scanned. When a specific fragment ion is observed, the parent ion which was fragmented to produce the specific fragment ion can then be determined. In theory a large number of parent ions admitted to the collision cell could have given rise to the specific fragment ion. The aim of such experiments is to screen for all components belonging to a particular class of compounds that may be recognised by a common fragment ion or to discover all parent ions that may contain a particular sub-component such as the phosphate functional group in phosphorylated peptides. However, if the transit time of ions through the collision cell is relatively long then the parent ions appear to become smeared across a number of masses and consequently resolution is reduced together with sensitivity. This effect is particularly exacerbated when the mass analyser upstream of the collision cell is scanned at a relatively high scan rate when sensitivity may be completely lost.

Neutral loss/gain scanning modes of operation are also used wherein both the mass analyser upstream of the collision cell and the mass filter/analyser downstream of the collision cell are scanned synchronously with a constant mass offset to identify those parent ions which fragment through loss of a specific functional group or react to form a specific product ion with a specific mass difference. A long transit time for ions through the collision cell may cause peak smearing but since the mass analyser downstream of the collision cell is scanning the smearing is not observed. The resultant effect is a loss of sensitivity and resolution (even though the loss of resolution may be obscured) which is again exacerbated at higher scan rates.

Long transit times are also a problem with reaction cells. Ions are typically injected into reaction cells with relatively low energies and RF confinement is used to cause the ions to interact with a background buffer gas and/or a reagent gas. Any axial velocity component above thermal levels is effectively lost and the ions can become effectively stranded within the reaction cell. In some situations, such as with short reaction cells, the ions may be deliberately trapped by application of trapping voltages at the entrance and exit of the reaction cell. This prolongs the ion-molecule interaction times but when the trapping voltages are removed the ions have no specific impetus towards the exit. Some ions will eventually diffuse to the exit but the duty cycle is poor and there is a risk of crosstalk with subsequent trapping cycles.

It is therefore known to reduce the RF voltage applied to the reaction cell between experiments to a level such that ions are no longer confined within the reaction cell.

With pulsed ion sources such as Laser Desorption Ionisation ("LDI") and Matrix Assisted Laser Desorption Ionization ("MALDI") ion sources the impetus of ions being effectively pushed through the collision cell by the space charge repulsion from continual ingress of ions is either not effectively present or is severely reduced consequently, ions from one pulse, or laser shot, can become merged with those from the next pulse and so on. Pulsed ion sources can advantageously be coupled to a discontinuous mass analyser such as a Time of Flight mass spectrometer, an ion trap mass spectrometer or a Fourier Transform Ion Cyclotron Resonance ("FTICR") mass spectrometer so that the operation of the mass analyzer can be synchronised with the pulses of ions emitted from the ion source. This enables the duty cycle for sampling ions and therefore sensitivity to be maximised. The smearing of each pulse of ions and the subsequent merging of one pulse with the next can compromise the opportunity to synchronise the mass analyser with the pulsed ion source. Hence it is no longer possible to maintain a high duty cycle and therefore sensitivity.

It is therefore desired to provide an improved fragmentation, collision, reaction or cooling cell for a mass spectrometer.

SUMMARY OF THE INVENTION

According to an aspect of the present invention there is provided a mass spectrometer comprising:

a fragmentation device comprising a plurality of electrodes wherein, in use, one or more transient DC voltages or one or more transient DC voltage waveforms are progressively applied to the electrodes so that ions are urged along the fragmentation device.

An axial voltage gradient may be provided along at least a portion of the length of the fragmentation device which varies with time whilst ions are being transmitted through the fragmentation device.

The fragmentation device may comprise at least a first electrode held at a first reference potential, a second electrode held at a second reference potential, and a third electrode held at a third reference potential, wherein:

at a first time $t_1$ a first DC voltage is supplied to the first electrode so that the first electrode is held at a first potential above or below the first reference potential;

at a second later time $t_2$ a second DC voltage is supplied to the second electrode so that the second electrode is held at a second potential above or below the second reference potential; and at a third later time $t_3$ a third DC voltage is supplied to the third electrode so that the third electrode is held at a third potential above or below the third reference potential.

Preferably, at the first time $t_1$ the second electrode is at the second reference potential and the third electrode is at the third reference potential;

at the second tire $t_2$ the first electrode is at the first potential and the third electrode is at the third reference potential; and at the third time $t_3$ the first electrode is at the first potential and the second electrode is at the second potential.

Alternatively, at the first time $t_1$ the second electrode is at the second reference potential and the third electrode is at the third reference potential;

at the second time $t_2$ the first electrode is no longer supplied with the first DC voltage so that the first electrode is returned to the first reference potential and the third electrode is at the third reference potential; and at the third time $t_3$ the second electrode is no longer supplied with the second DC voltage so that the second electrode is returned to the second reference potential and the first electrode is at the first reference potential.

Preferably, the first, second and third reference potentials are substantially the sate. The first, second and third DC voltages are also preferably substantially the same. Preferably, the first, second and third potentials are substantially the same.

According to an embodiment the fragmentation device comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential. Preferably, a plurality of segments are maintained at substantially the same DC potential. According to an embodiment each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

Ions are preferably confined radially within the fragmentation device by an AC or RF electric field. Ions are preferably radially confined within the fragmentation device in a pseudo-potential well and are constrained axially by a real potential barrier or well.

The transit time of ions through the fragmentation device is preferably selected from the group consisting of: (i) less than or equal to 20 ms; (ii) less than or equal to 10 ms; (iii) less than or equal to 5 ms; (iv) less than or equal to 1 ms; and (v) less than or equal to 0.5 Ms.

According to the preferred embodiment at least 50%, 60%, 70%, 80%, 90% or 95% of the ions entering the fragmentation device are arranged to have, in use, an energy greater than or equal to 10 eV for a singly charged ion or greater than or equal to 20 eV for a doubly charged ion such that the ions are caused to fragment. Preferably, at least 50%, 60%, 70%, 80%, 90% or 95% of the ions entering the fragmentation device are arranged to fragment upon colliding with collision gas within the fragmentation device.

Preferably, the fragmentation device is maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

Preferably, the fragmentation device is maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

Preferably, the fragmentation device is maintained, in use, at a pressure selected prom the group consisting of; (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

The fragmentation device is preferably maintained, in use, at a pressure such that a viscous drag is imposed upon ions passing through the fragmentation device.

One or more transient DC voltages or one or more transient DC voltage waveforms are preferably initially provided at a first axial position and are then subsequently provided at second, then third different axial positions along the fragmentation device.

Preferably, the one or more transient DC voltages or the one or more transient DC voltage waveforms move in use from one end of the fragmentation device to another end of the fragmentation device so that ions are urged along the fragmentation device.

The one or more transient DC voltages preferably create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage waveforms preferably comprise a repeating waveform such as a square wave.

The amplitude of the one or more transient DC voltages or the one or more transient DC voltage waveforms preferably remains substantially constant with time. Alternatively, the amplitude of the one or more transient DC voltages or the one or more transient DC voltage waveforms varies with time. For example, the amplitude of the one or more transient DC voltages or the one or more transient DC voltage waveforms may either; (i) increases with time; (ii) increases then decreases with time; (iii) decreases with time; or (iv) decreases then increases with time.

The fragmentation device preferably comprises an upstream entrance region, a downstream exit region and an intermediate region, wherein:

in the entrance region the amplitude of the one or more transient DC voltages or the one or more transient DC voltage waveforms has a first amplitude;

in the intermediate region the amplitude of the one or more transient DC voltages or the one or more transient DC voltage waveforms has a second amplitude; and in the exit region the amplitude of the one or more transient DC voltages or the one or more transient DC voltage waveforms has a third amplitude.

Preferably, the entrance and/or exit region comprise a proportion of the total axial length of the fragmentation device selected from the group consisting of; (i) <5%; (ii) 5–10%; (iii) 10–15%; (iv) 15–20%; (v) 20–25%; (vi) 25–30%; (vii) 30–35%; (viii) 35–40%; and (ix) 40–45%.

The first and/or third amplitudes are preferably substantially zero and the second amplitude is preferably substantially non-zero.

The second amplitude is preferably larger than the first amplitude and/or the second amplitude is larger than the third amplitude.

Preferably, one or more transient DC voltages or one or more transient DC voltage waveforms pass in use along the fragmentation device with a first velocity. The first velocity preferably either: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

The one or more transient DC voltages or the one or more transient DC voltage waveforms preferably cause ions within the fragmentation device to pass along the fragmentation device with a second velocity.

The difference between the first velocity and the second velocity is preferably less than or equal to 100 m/s, 90 m/s, 80 m/s, 70 m/s, 60 m/s, 50 m/s, 40 m/s, 30 m/s, 20 m/s, 10 m/s, 5 m/s or 1 m/s.

The first velocity is preferably selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (Xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

The second velocity is preferably selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

Preferably, the second velocity is substantially the same as the first velocity.

The one or more transient DC voltages or the one or more transient DC voltage waveforms preferably have a frequency, and wherein the frequency; (i) remains substantially constant; (ii) varies; (iii) increases; (iv) increases then decreases; (v) decreases; or (vi) decreases then increases.

The one or more transient DC voltages or the one or more transient DC voltage waveforms preferably has a wavelength, and wherein the wavelength: (i) remains substantially constant; (ii) varies; (iii) increases; (iv) increases then decreases; (v) decreases; or (vi) decreases then increases.

According to an embodiment two or more transient DC voltages or two or more transient DC waveforms are arranged to pass simultaneously along the fragmentation device. The two or more transient DC voltages or the two or more transient DC waveforms may be arranged to move: (i) in the same direction; (ii) in opposite directions; (iii) towards each other; or (iv) away from each other.

The one or more transient DC voltages or the one or more transient DC waveforms may be repeatedly generated and passed in use along the fragmentation device. The frequency of generating the one or more transient DC voltages or the one or more transient DC voltage waveforms preferably: (i) remains substantially constant; (ii) varies; (iii) increases; (iv) increases then decreases; (v) decreases; or (vi) decreases then increases.

According to an embodiment a continuous beam of ions is received at an entrance to the fragmentation device. Alternatively, packets of ions are received at an entrance to the fragmentation device.

According to the preferred embodiment pulses of ions emerge from an exit of the fragmentation device.

The mass spectrometer preferably further comprises an ion detector, the ion detector being arranged to be substantially phase locked in use with the pulses of ions emerging from the exit of the fragmentation device.

The mass spectrometer preferably further comprises a Time of Flight mass analyser comprising an electrode for injecting ions into a drift region, the electrode being arranged to be energised in use in a substantially synchronised manner with the pulses of ions emerging from the exit of the fragmentation device.

Other embodiments are also contemplated wherein the mass spectrometer further comprises an ion trap arranged downstream of the ion guide, the ion trap being arranged to store and/or release ions from the ion trap in a substantially synchronised manner with the pulses of ions emerging from the exit of the ion guide.

Another embodiment is contemplated wherein the mass spectrometer further comprises an mass filter arranged downstream of the ion guide, wherein a mass to charge ratio transmission window of the mass filter is varied in a substantially synchronised manner with the pulses of ions emerging from the exit of the ion guide.

The fragmentation device may comprise an ion funnel comprising a plurality of electrodes having apertures therein through which ions are transmitted, wherein the diameter of the apertures becomes progressively smaller or larger. Alternatively, the fragmentation device may comprise an ion tunnel comprising a plurality of electrodes having apertures therein through which ions are transmitted, wherein the diameter of the apertures remains substantially constant. The fragmentation device may comprise a stack of plate, ring or wire loop electrodes.

The fragmentation device may comprise a plurality of electrodes, each electrode having an aperture through which ions are transmitted in use. Each electrode preferably has a substantially circular aperture. Preferably, each electrode has a single aperture through which ions are transmitted in use.

Preferably, the diameter of the apertures of at least 50%, 60%, 70%, 80%, 90% or 95% of the electrodes forming the fragmentation device is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

At least 50%, 60%, 70%, 80%, 90% or 95% of the electrodes forming the fragmentation device preferably have apertures which are substantially the same size or area.

According to a less preferred embodiment the fragmentation device comprises a segmented rod set.

Preferably, the fragmentation device consists of; (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

The thickness of at least 50%, 60%, 70%, 80%, 90% or 95% of the electrodes is preferably selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

The fragmentation device preferably has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

The fragmentation device preferably comprises a housing having an upstream opening for allowing ions to enter the fragmentation device and a downstream opening for allowing ions to exit the fragmentation device.

The fragmentation device may further comprise an inlet port through which a collision gas is introduced. The collision gas may comprise air and/or one or more inert gases and/or one or more non-inert gases. Preferably, at least 10%, 20%, 30%, 40%, 50%, 60%, 70%, 80%, 90%, or 95% of the electrodes are connected to both a DC and an AC or RF voltage supply. Axially adjacent electrodes are preferably supplied with AC or RF voltages having a phase difference of 180°.

The mass spectrometer may comprise an ion source selected from the group consisting of: (i) Electrospray ("ESI") ion source; (ii) Atmospheric Pressure Chemical Ionisation ("APCI") ion source; (iii) Atmospheric Pressure Photo Ionisation ("AAPPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI") ion source; (viii) Chemical Ionisation ("CI") ion source; (ix) a Fast Atom Bombardment ("FAB") ion source; and (x) a Liquid Secondary Ions Mass Spectrometry ("LSIMS") ion source.

The ion source may comprise a continuous ion source or a pulsed ion source.

According to another aspect of the present invention there is provided a mass spectrometer comprising:

a reaction cell wherein in use ions react and/or exchange charge with a gas in the reaction cell, the reaction cell comprising a plurality of electrodes wherein, in use, one or more transient DC voltages or one or more transient DC voltage waveforms are progressively applied to the electrodes so that ions are urged along the reaction cell.

All the preferred features discussed above in relation to a collision cell are equally applicable to a reaction cell according to a preferred embodiment.

According to another aspect of the present invention there is provided a mass spectrometer comprising:

a cell comprising a gas for damping, collisionally cooling, decelerating, axially focusing or otherwise thermalising ions without substantially fragmenting the ions, the cell comprising a plurality of electrodes wherein, in use, one or more transient DC voltages or one or more transient DC voltage waveforms are progressively applied to the electrodes so that ions are urged along the cell.

All the preferred features discussed above in relation to a collision cell are equally applicable to a cell comprising a gas for damping, collisionally cooling, decelerating, axially focusing or otherwise thermalising ions according to a preferred embodiment.

According to another aspect of the present invention there is provided a mass spectrometer comprising:

an ion source;

a mass filter;

a fragmentation device comprising a plurality of electrodes wherein, in use, one or more transient DC voltages or one or more transient DC voltage waveforms are progressively applied to the electrodes so that ions are urged along the fragmentation device; and a mass analyser.

An ion guide may be arranged upstream of the mass filter. The ion guide preferably comprises a plurality of electrodes wherein at least some of the electrodes are connected to both a DC and an AC or RF voltage supply. One or more transient DC voltages or one or more transient DC voltage waveforms may be passed in use along at least a portion of the length of the ion guide to urge ions along the portion of the length of the ion guide.

The mass filter may comprise a quadrupole mass filter. The mass analyser may comprise a Time of Flight mass analyser, a quadrupole mass analyser or a Fourier Transform Ion Cyclotron Resonance ("FTICR") mass analyser. The mass analyser may also comprise a 2D (linear) quadrupole ion trap or a 3D (Paul) quadrupole ion trap.

According to another aspect of the present invention there is provided a mass spectrometer comprising:

a fragmentation device comprising a plurality of electrodes having apertures, wherein ions are radially confined within the fragmentation device by an AC or RF voltage such that adjacent electrodes have a phase difference of 180°, and wherein one or more DC voltage pulses or one or more transient DC voltage waveforms are applied successively to a plurality of the electrodes so that ions are urged towards an exit of the fragmentation device and have a transit time of less than 20 ms through the fragmentation device.

According to another aspect of the present invention there is provided a mass spectrometer comprising a fragmentation device having a plurality of electrodes wherein one or more DC voltage pulses or one or more transient DC voltage waveforms are applied to successive electrodes.

According to another aspect of the present invention there is provided a method of mass spectrometry comprising:

providing a fragmentation device comprising a plurality of electrodes; and progressively applying one or more transient DC voltages or one or more transient DC voltage waveforms to the electrodes so that ions are fragmented within the fragmentation device and are urged along the fragmentation device.

Preferably, the step of progressively applying one or more transient DC voltages or one or more transient DC voltage waveforms comprises maintaining an axial voltage gradient which varies with time whilst ions are being transmitted through the fragmentation device.

Preferably, the one or more transient DC voltages or the one or more transient DC voltage waveforms are passed along the fragmentation device with a first velocity.

The first velocity is preferably selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

According to another aspect of the present invention there is provided a method of reacting ions and/or exchanging the charge of ions with a gas comprising:

providing a reaction cell comprising a plurality of electrodes; and progressively applying one or more transient DC voltages or one or more transient DC voltage waveforms to the electrodes so that ions are urged along the reaction cell.

According to another aspect of the present invention there is provided a method of damping, collisionally cooling, decelerating, axially focusing or otherwise thermalizing ions without substantially fragmenting the ions comprising:

providing a cell comprising a plurality of electrodes; and progressively applying one or more transient DC voltages to the electrodes so that ions are urged along the cell.

According to one embodiment a repeating pattern of DC electrical potentials is superimposed along the length of a collision, reaction or cooling cell so as to form a periodic DC potential waveform. The DC waveform may then be caused to effectively travel along the collision, reaction or cooling cell in the direction and at a velocity at which it is desired to move the ions.

The collision, reaction or cooling cell preferably comprises an AC or RF cell such as a multipole rod set or stacked ring set which is segmented in the axial direction so that independent transient DC potentials can be applied to each segment such transient DC potentials are preferably superimposed on top of the RF radially confining voltage and also on top of any constant DC offset voltage which may be applied to all the electrodes forming the cell. The transient DC potentials applied to the electrodes generate a travelling DC potential wave in the axial direction.

At any instant in time a voltage gradient is generated between segments which has the effect of pushing or pulling ions in a certain direction. As the ions move in the required direction the DC voltage gradient also moves. The individual DC voltages on each of the segments may be programmed to create a required waveform. Furthermore, the individual DC voltages on each of the segments may be programmed to change in synchronism so that a waveform is maintained but translated in the direction in which it is required to move the ions. No constant axial DC voltage gradient is required although less preferably one may be provided.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
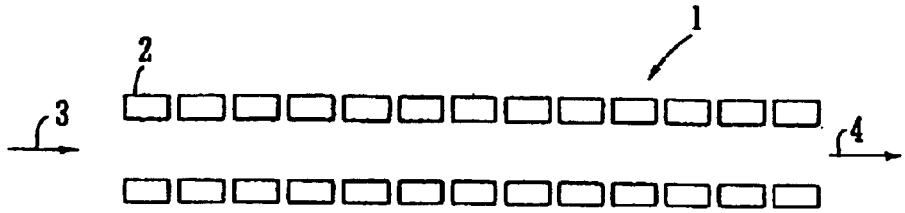
FIG. 1 shows a segmented collision, reaction or cooling cell according to a preferred embodiment.

A preferred collision, reaction or cooling cell 1 will now be described in relation to FIG. 1. The collision, reaction or cooling cell 1 comprises a plurality of electrodes 2 provided along the length of the collision, reaction or cooling cell 1. According to one embodiment the collision, reaction or cooling cell 1 may comprise a plurality of substantially circular electrodes 2 having apertures through which ions are transmitted. According to another embodiment the collision, reaction or cooling cell 1 may comprise a segmented rod set.

The electrodes 2 forming the collision, reaction or cooling cell 1 may be grouped together into a number of segments. Each segment may comprise a plurality of electrodes which are preferably maintained at substantially the same DC potential. The various segments may be arranged so that, for example, the first, fourth, seventh . . . segments are maintained at the same DC potential, the second, fifth, eighth . . .

segments are maintained at the same DC potential and the third, sixth, ninth . . . segments are maintained at the same DC potential.

A transient DC voltage or a repeating waveform is preferably progressively applied to the various segments or individual electrodes 2 forming the collision, reaction or cooling cell 1. The transient DC voltage(s) which is preferably progressively applied to the collision, reaction or cooling cell 1 may comprise DC potentials above and/or below that of a constant (or less preferably non-constant) DC voltage offset at which the electrodes 2 or segments are normally maintained at. The transient DC voltage or repeating DC potential waveform has the effect of urging ions along the axis of the collision, reaction or cooling cell 1 from the entrance of the collision, reaction or cooling cell 3 to the exit 4 of the collision, reaction or cooling cell 1.

Figure 2:
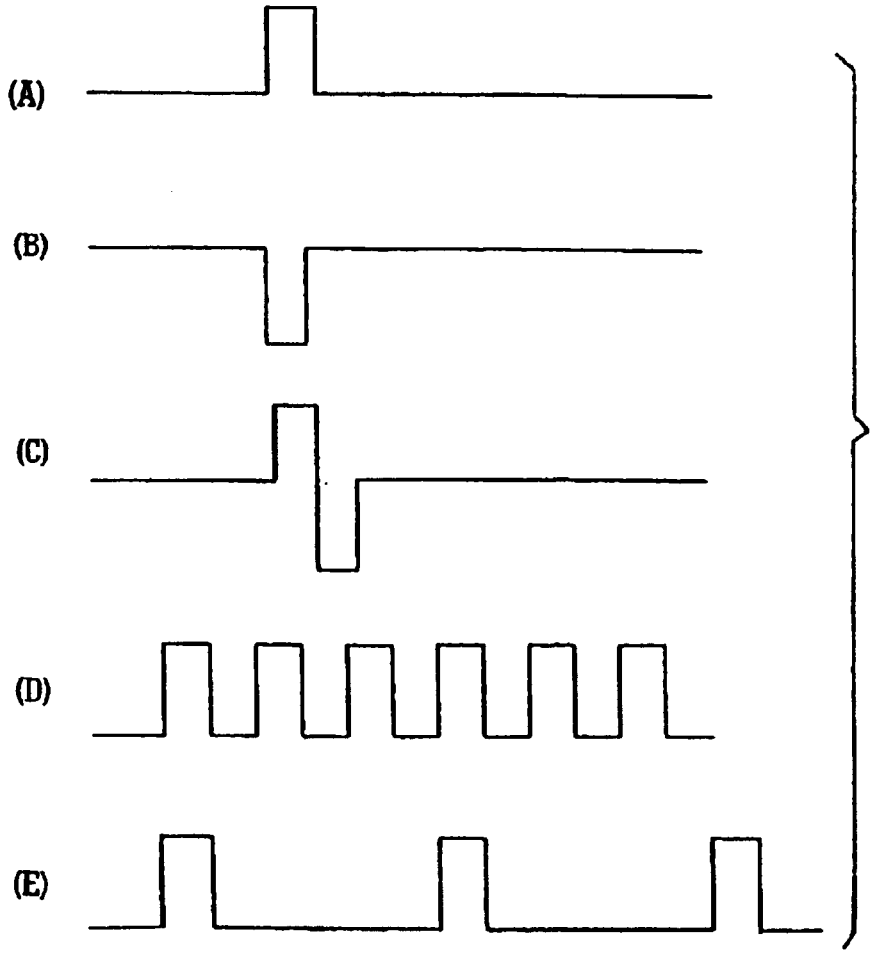
FIG. 2A shows a DC potential barrier waveform.
FIG. 2B shows a DC potential well waveform.
FIG. 2C shows a DC potential barrier and well waveform.
FIG. 2D shows a DC potential repeating waveform and FIG. 2E shows another DC potential repeating waveform.

The transient DC voltage or repeating DC potential waveform which is applied to the electrodes 2 or segments may take several different forms For example, FIG. 2A shows a single potential hill or barrier which may be progressively passed to segments or electrodes 2 along the length of the collision, reaction or cooling cell 1. FIG. 2B shows another potential waveform which comprises a single potential well. FIG. 2C shows a potential waveform wherein a single potential well followed by a single potential hill or barrier which may be passed along the collision, reaction or cooling cell 1. FIG. 2D shows a DC potential waveform comprising a repeating DC potential hill or barrier. FIG. 2E shows another preferred DC potential waveform. It will be appreciated that other different potential waveforms apart from those shown in FIGS. 2A–2E are contemplated.

The DC voltages applied to each segment or electrode 2 forming the collision, reaction or cooling cell 1 may be programmed to change continuously or in a series of steps. The sequence of voltages applied to each electrode 2 or segment may repeat at regular intervals or alternatively at intervals which may progressively increase or decrease.

The time over which a complete sequence of DC voltages is applied to a particular electrode 2 or segment is the cycle time T and the inverse of the cycle time is the wave frequency f. The distance along the AC or RF collision, reaction or cooling cell 1 over which the travelling DC potential waveform repeats itself is the wavelength λ. The wavelength divided by the cycle time T is the velocity $v_{wave}$ of the travelling DC potential wave ("travelling wave"). Hence, the travelling wave velocity $v_{wave}$:

$$v_{wave} = \frac{\lambda}{T} = \lambda f$$

The velocity of the ions entering the collision cell, reaction or cooling 1 is preferably arranged to substantially match that of the travelling DC potential wave. For a given wavelength, the travelling wave velocity may be controlled by appropriate selection of the cycle time. If the cycle time T is progressively increased then the velocity of the travelling wave progressively decreases. The optimum velocity of the travelling wave may depend upon the mass of the ions to be fragmented or reacted and the pressure and composition of the collision gas.

The collision, reaction or cooling cell 1 is preferably operated at intermediate pressures between 0.0001 and 100 mbar, further preferably between 0.001 and 10 mbar. The gas density is preferably sufficient to impose a viscous drag on the ions being transmitted through the collision, reaction or cooling cell 1. At such pressures the gas will appear as a viscous medium to the ions and will have the effect of slowing the ions. Viscous drag resulting from frequent collisions with gas molecules effectively prevents the ions from building up excessive velocity. Consequently, the ions will tend to ride with the travelling DC wave rather than run ahead of the DC potential wave and execute excessive oscillations within the travelling potential wells.

The presence of the gas imposes a maximum velocity at which the ions will travel through the gas for a given field strength. The higher the gas pressure, the more frequent ion-molecule collisions will be and the slower the ions will travel for a given field strength. The energy of the ions will also be dependent upon their mass and the square of their velocity. If fragmentation is required then conventionally the energy of the ions is kept above a particular value usually approximately 10 eV.

In addition to reducing the transit time through the collision, reaction or cooling cell 1 a further particular advantage of the preferred collision, reaction or cooling cell 1 is that the ions will exit the collision, reaction or cooling cell 1 as a pulsed beam of ions. This will be true irrespective of whether the ion beam entering the collision, reaction or cooling cell 1 is continuous or pulsed. Furthermore, the collision, reaction or cooling cell 1 may in one embodiment transport a series of ion packets without allowing the ions in one packet to become dispersed and merged with another packet. The repetition rate of the pulses of ions emitted from the collision, reaction or cooling cell 1 may be synchronised with a downstream mass analyser in terms of scan rates and acquisition times. For example, in a scanning quadrupole system, the repetition rate is preferably high enough to prevent pulsing across the mass range. In a triple quadrupole tandem mass spectrometer operating in a MM mode the repetition frequency may be compatible with the reaction monitoring dwell times. In a quadrupole Time of Flight tandem mass spectrometer the repetition frequency may be substantially synchronised with the pusher pulses of the Time of Flight mass analyser to maximise the ion sampling duty cycle and hence sensitivity.

Advantageously, the collision, reaction or cooling cell 1 according to the preferred embodiment allows the detection system to be phase locked with the ion pulses emitted from the collision, reaction or cooling cell 1. The detection system response may be modulated or pulsed in the same way that the ion beam is modulated or pulsed. This provides a means of improving the signal to noise of the ion detection system since any continuous noise, white noise, or DC offset in the detection system can be substantially eliminated from the detected signal.

Another advantage is gained when the travelling wave collision, reaction or cooling cell 1 is interfaced with a discontinuous mass analyser. The pulsing of an orthogonal acceleration Time of Flight mass spectrometer, for example, may be synchronised with the travelling wave frequency to maximise the duty cycle for ions of a particular range of mass to charge ratios. The range of masses for which the duty cycle is maximised will be determined by the distance from the exit of the travelling wave collision, reaction or cooling cell 1 to the orthogonal acceleration region, the energy of the ions and the phase shift between that of the travelling waveform and that of the pulsing of the orthogonal acceleration Time of Flight mass spectrometer.

If the beam of ions arriving at the entrance to the travelling wave collision, reaction or cooling cell 1 arrives as a pulse of ions then they will also exit the collision, reaction or cooling cell 1 as a pulse of ions. The pulse of ions arriving at the travelling wave collision, reaction or cooling cell 1 is preferably synchronised with the travelling waveform so that the ions arrive at the optimum phase of that waveform i.e. the arrival of the ion pulse preferably coincides with a particular phase of the waveform. This is particularly useful when using a pulsed ion source, such as a Laser Desorption Ionisation ("LDI") or a Matrix Assisted Laser Desorption Ionisation ("MALDI") ion source or when ions are released from an ion trap and where it is desired not to allow the pulse of ions to become dispersed or otherwise broadened.

Under conditions of intermediate gas pressures, where ion-molecule collisions are likely to occur, ions are positively forced to exit the collision, reaction or cooling cell 1 which significantly reduces their transit time though the collision, reaction or cooling cell 1. The preferred embodiment also has the advantage of reducing or eliminating memory effects or crosstalk in fast switching experiments where ions are fragmented by or reacted with gas molecules. The preferred embodiment also addresses the problem of loss of sensitivity and resolution in parent ion scanning and in neutral loss or gain scanning on tandem mass spectrometers employing a gas collision cell which is observed using conventional collision cells.

The amplitude of a travelling DC potential or repeating waveform applied to the electrodes 2 or segments of the collision, reaction or cooling cell 1 may be progressively attenuated towards one end, preferably the entrance 3, of the collision, reaction or cooling cell 1. The amplitude of the repeating DC potential waveform may therefore grow to its full amplitude over the first few electrodes or segments of the collision, reaction or cooling cell 1. This allows ions to be introduced into the collision, reaction or cooling cell 1 with minimal disruption to their sequence.

According to a particularly preferred embodiment the gas collision, reaction or cooling cell 1 comprises a stacked ring RF ion guide 180 mm long and made from 120 stainless steel rings each 0.5 mm thick and spaced apart by 1 mm. The internal aperture of each ring is preferably 5 mm in diameter. The frequency of the RF supply is preferably 1.75 MHz and the peak RF voltage may be varied up to 500 v. The stacked ring ion guide is preferably mounted in an enclosed collision cell chamber positioned between two quadrupole mass filters of a triple quadrupole mass spectrometer. The pressure in the enclosed collision cell chamber may be varied up to 0.01 mbar. According to other embodiments higher pressures may be used.

According to one embodiment the stacked ring RF collision, reaction or cooling cell 1 may be divided into 15 segments each 12 mm long and consisting of 8 rings. Three different DC voltages may be connected to three adjacent segments so that a sequence of voltages applied to the first three segments may be repeated a further four times along the length of the collision, reaction or cooling cell 1. The three DC voltages which are preferably applied to the three segments may be independently programmed up to 40 V. The sequence of voltages applied to the segments creates a waveform with a potential hill repeated five times along the length of the collision, reaction or cooling cell 1. According to this embodiment the wavelength of the travelling DC potential waveform is 36 mm (3×12 mm). The cycle time for the sequence of voltages on any one segment is 23 $\mu$s, and hence the travelling wave velocity is 1560 m/s (36 mm/23 $\mu$s).

Figure 3:
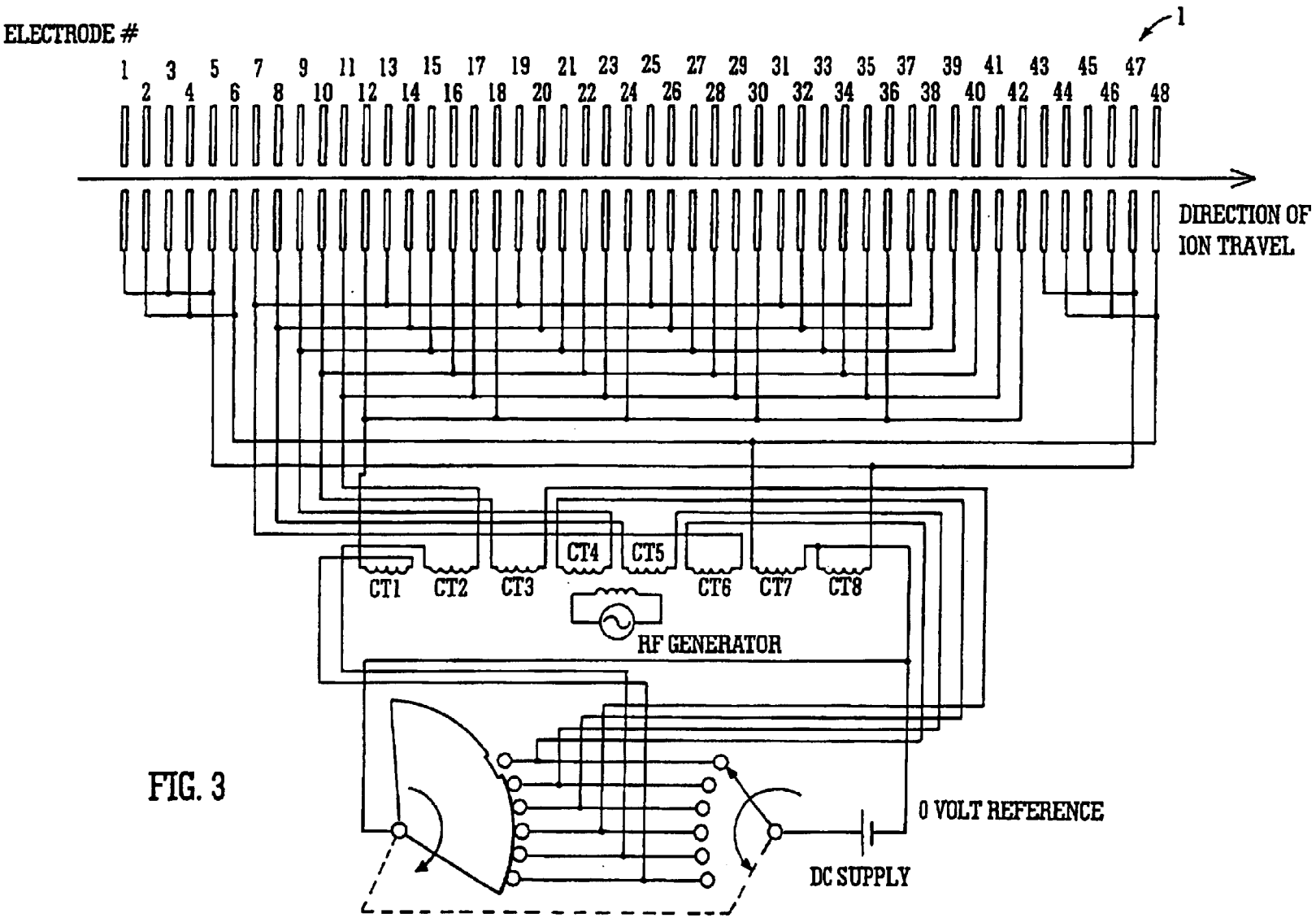
FIG. 3 illustrates how a repeating transient DC voltage waveform may be generated.

The operation of a travelling wave ion guide will now be described with reference to FIG. 3. The preferred embodiment preferably comprises 120 electrodes but only 48 electrodes are shown in FIG. 3 for ease of illustration.

Alternate electrodes are preferably fed with opposite phases of an AC or RF supply (preferably 1 MHz and 500 V p—p). The collision, reaction or cooling cell 1 may be divided into separate groups of electrodes (6 groups of electrodes are shown in FIG. 3). The electrodes in each group may be fed from separate secondary windings on a coupling transformer as shown in FIG. 3. These are connected so that all the even-numbered electrodes are 180° out of phase with all the odd-numbered electrodes. Therefore, at the point in the RF cycle when all the odd numbered electrodes are at the peak positive voltage, all the even-numbered electrodes are at the peak negative voltage.

Groups of electrodes at each end of the stack (e.g. electrodes #1–6 and #43–48) may be supplied with RF only potentials whereas the central groups (e.g. electrodes #7–12, #13–18, #19–24, #25–30, #31–36 and #37–42) may be supplied with both RF and DC potentials. Therefore, electrodes #1, #3, #5, #43, #45 and #47 may be connected to one pole of the secondary winding CT8, and electrodes #2, #4, #6, #44, #46, and #48 may be connected to the opposite end of winding CT7 to ensure the correct RF phasing of the electrodes. The other ends of these windings are connected to the 0 V DC reference so that only RF potentials are applied to the end groups of electrodes. Electrodes #7, #13, #19, #24, #31 and #37 which are the first electrodes of each of the central groups are connected together and fed from secondary winding CT6. Windings CT5, CT4, CT3, CT2 and CT1 respectively supply the second through sixth electrodes of each of central groups. Each of windings CT1–6 is referred to a different DC reference point shown schematically by the 2-gang switch in FIG. 3 so that the first through sixth sets of electrodes of the central groups can be supplied with a DC potential selected by the switch, as well as the RF potentials.

In a mode of operation only one set of interconnected electrodes comprised in the central groups is supplied with a DC voltage at any given instant. All the other windings are referenced to 0V DC at that particular instant. For example, with the switch in the position illustrated in FIG. 3, winding CT6 of the transformer may be connected to the DC supply biasing all the first electrodes (e.g. electrodes #7, #13, #19 etc.) of the central groups relative to all other electrodes.

If the switch is then moved to the next position, winding CT5 is connected to the DC supply, biasing all the second electrodes (e.g. electrodes #8, #14, #20 etc.) while the first electrodes (e.g. electrodes #7, #13, #19 etc.) are returned to 0 V DC.

When used as a travelling wave collision, reaction or cooling cell 1 the switch can be effectively rotated continuously biasing in turn the first through sixth electrodes and then repeating the sequence without interruption. A mechanical switch is shown in FIG. 3 for sake of illustration, however electronic switching may more preferably be used to carry out the switching. Each transformer winding CT1–8 may be fed by a Digital to Analogue Converter which can apply the desired DC potential to the winding under computer control.

Typical operating conditions may have an RF peak-to-peak voltage of 500 V, an RF frequency of 1 MHz, a DC bias of +5 V (for positive ions) and a switching frequency of 101–100 kHz.

If a positive ion enters the electrode stack when the switch is in the position shown in FIG. 3 and a positive DC potential is applied to electrode #7 then the ion will encounter a potential barrier at electrode #7 which prevents its further passage along the collision, reaction or cooling cell 1 (assuming that its translational kinetic energy is not too high). As soon as the switch moves to the next position, however, this potential barrier will shift to electrode #8 then #9, #10, #11 and #12 upon further rotation of the switch. This allows the ion to move further along the collision, reaction or cooling cell 1. On the next cycle of operation of the switch, the potential barrier in front of the ion moves to electrode #13 and a new potential barrier now appears on electrode #7 behind the ion. The ion therefore becomes contained or otherwise trapped in a potential well between the potential barriers on electrodes #7 and #13. Further rotation of the switch moves the potential well from electrodes #7–13 to electrodes #8–14, then #9–15, through to #12–18. A further cycle of the switch moves this potential well in increments of one electrode from electrodes #12–18 through to electrodes #18–24. The process repeats thereby pushing the ion along the collision, reaction or cooling cell 1 in its potential well until it emerges into the RF only exit group of electrodes #43–48 and then subsequently leaves the collision, reaction or cooling cell 1.

As a potential well moves along the collision, reaction or cooling cell 1, new potential wells capable of containing more ions may be created and moved along behind it. The travelling wave collision, reaction or cooling cell 1 may therefore carry individual packets of ions along its length in the travelling potential wells whilst the strong-focusing action of the RF field will simultaneously tend to confine the ions to the axial region.

According to a particularly preferred embodiment a mass spectrometer is provided having two quadrupole mass filters/analysers and a travelling wave collision, reaction or cooling cell 1. An ion guide may also be provided upstream of the first mass filter/analyser. A transient DC potential waveform is preferably applied to the collision, reaction or cooling cell 1 and may also be applied to the ion guide upstream of the first mass filter/analyser. The transient DC potential waveform applied to the collision, reaction or cooling cell 1 preferably has a wavelength of 14 electrodes. The DC voltage is preferably applied to neighbouring pairs of plates and is stepped in pairs hence there are 7 steps in one cycle. Accordingly, at any one time there are two electrodes with a transient DC voltage applied to them followed by 12 electrodes with no transient DC voltage applied followed by two electrodes with a transient applied DC voltage followed by a further 12 electrodes with no transient applied DC voltage etc.

A buffer gas (typically nitrogen or helium) may be introduced into the collision, reaction or cooling cell 1. The buffer gas is a viscous medium and will tend to dampen the motion of the ions and to thermalise the ion translational energies. Therefore, ions entering the collision, reaction or cooling cell 1 will fragment or react and the fragment or product ions will become thermalised by collisional cooling irrespective of the kinetic energy possessed by the ions. The fragment or product ions may be confined in potential wells as they travel through the collision, reaction or cooling cell 1. Assuming that the potential barriers are sufficiently high to ensure the ions remain in the potential well, their transit time through the collision, reaction or cooling cell 1 will be independent of both their initial kinetic energy and the gas pressure and hence will be determined solely by the rate at which the potential wells are moved or translated along the collision, reaction or cooling cell 1 which is a function of the switching rate of the electrode potentials. This property can be exploited advantageously in a number of applications and leads to improvements in performance when compared to instruments using conventional rod-set or ring-set guides in which this control is unavailable.

Some experimental data relating to the preferred collision cell will now be presented.

In a first experiment the compound Reserpine was ionised using an Electrospray Ionisation source. The $(M+H)^+$ ion for Reserpine has a mass to charge ratio of 609 and is known to fragment into fragment ions having a mass to charge ratio of 195. Further experimental data relating to Reserpine is presented in FIGS. 12A–G.

Figure 4A:
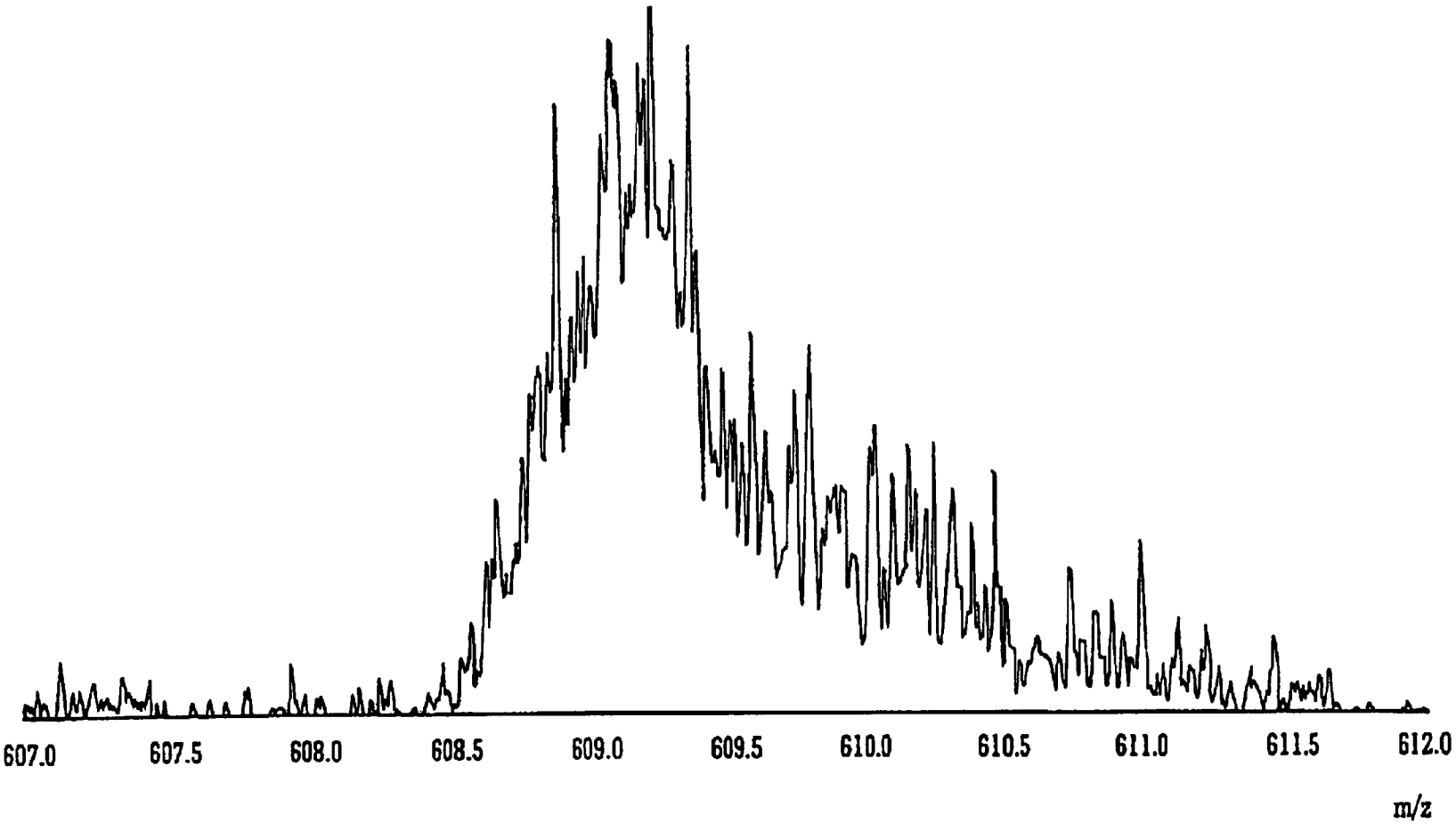
FIG. 4A shows a partial mass spectrum obtained according to the preferred embodiment and FIG. 4B shows a comparable conventional mass spectrum.
Figure 4B:
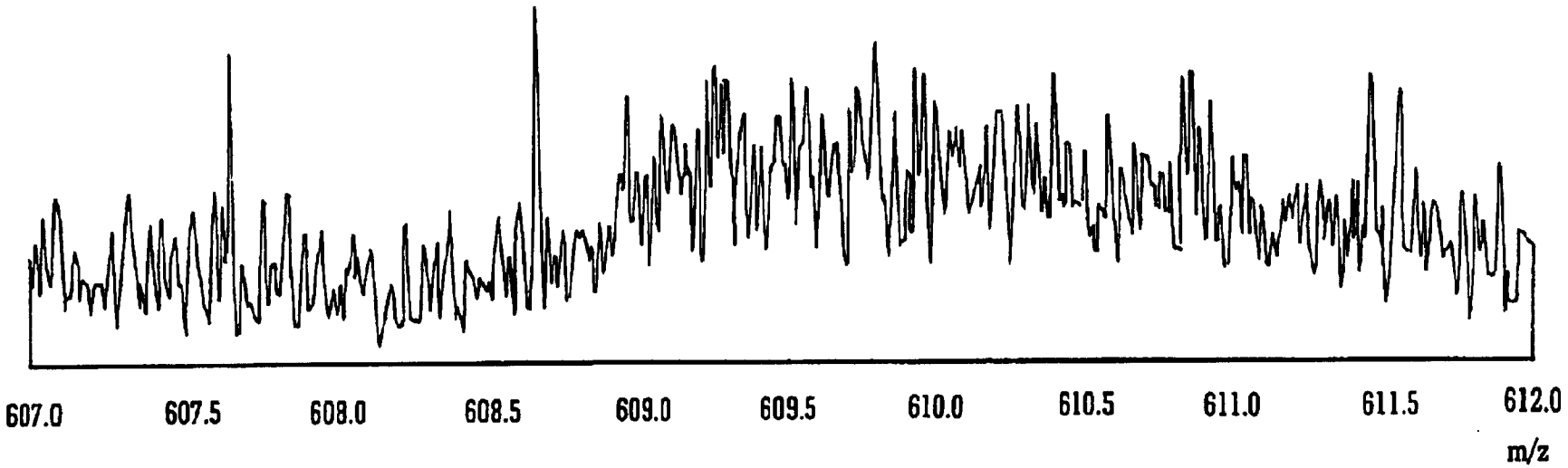

In the first experiment, a parent ion scan for daughter ions having a mass to charge ratio of 195 was recorded at a scan rate of 5 Daltons in 1 second. Mass spectra were recorded with and without the assistance of a travelling DC potential being progressively applied along the length of the collision cell 1 according to the preferred embodiment. As can be seen from FIG. 4B, without a travelling DC potential being applied to the collision cell 1 the mass peak correlating to the parent ion at mass to charge 609 was observed to be very broad (at least 3 Daltons wide) and has a low intensity relative to the background. However, as can be seen from FIG. 4A when a travelling DC wave was applied to the collision cell (with a master clock frequency of 130 kHz) the mass peak corresponding to the parent ion became significantly narrower (about 1 Dalton wide) and about three times more intense than the mass peak shown in FIG. 4B which was obtained using a conventional collision cell.

Figure 5A:
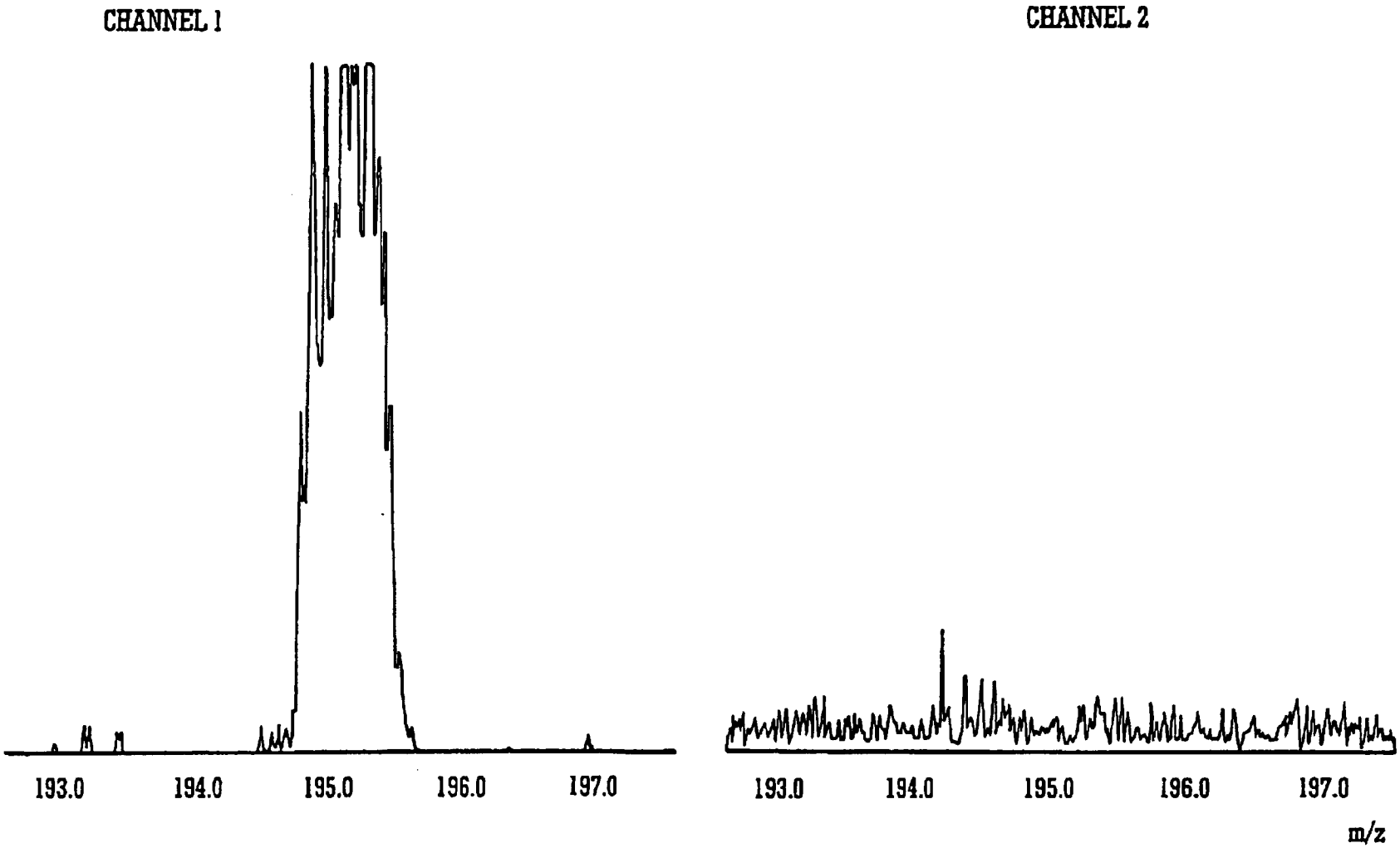
FIG. 5A shows data relating to two channels from a MRM experiment which were obtained according to the preferred embodiment and FIG. 5B shows data relating to two channels which were obtained according to a conventional arrangement.
Figure 5B:
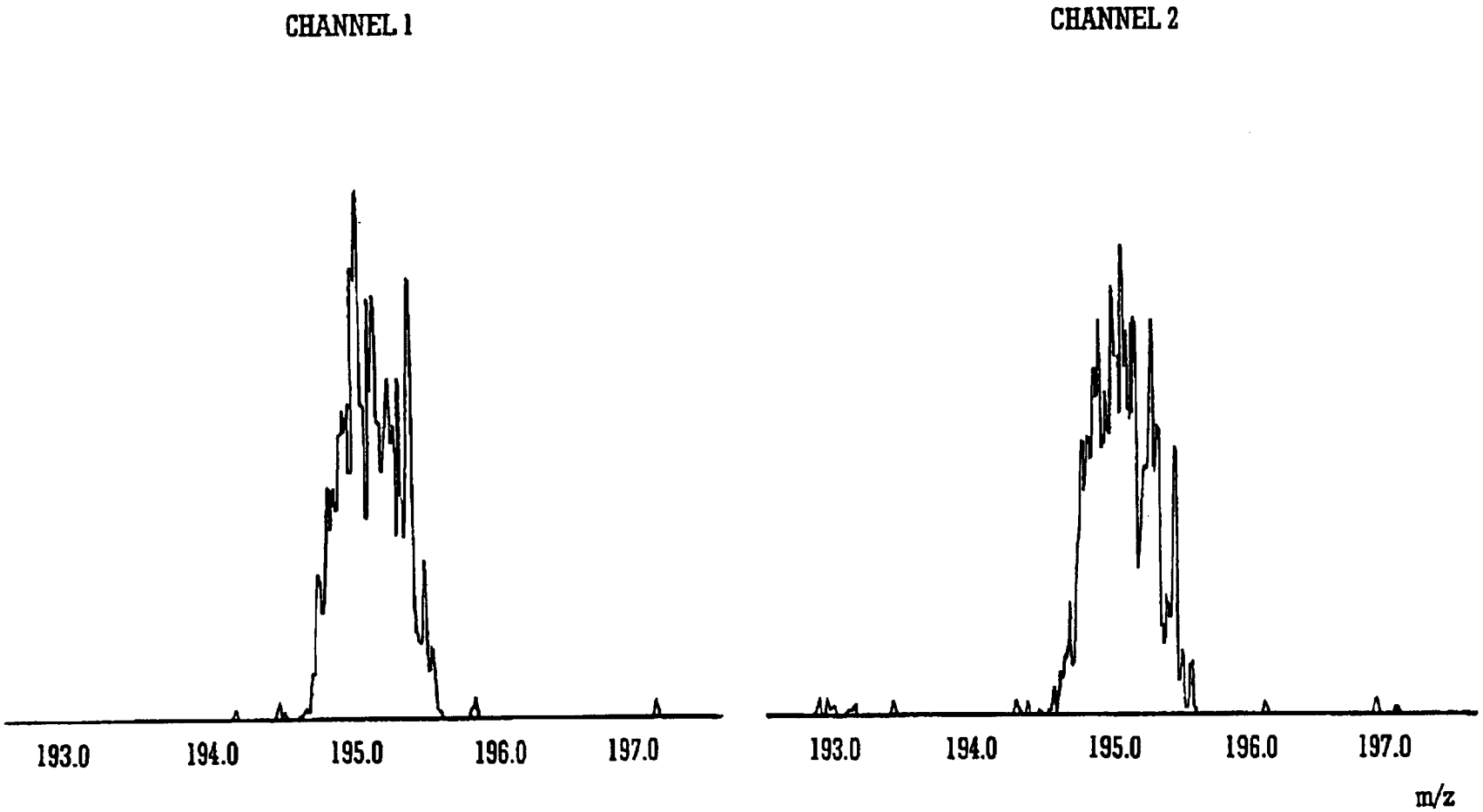

In another experiment a two channel Multiple Reaction Monitoring ("MRM") experiment was set up. A first channel ("Channel 1") monitored the transition of Reserpine parent ions having a mass to charge ratio 609 fragmenting into daughter ions having a mass to charge ratio of 195. A second channel ("Channel 2") monitored a non-existent transition of ions having a mass to charge ratio of 612 fragmenting into ions having a mass to charge ratio of 195. The second channel was therefore a dummy channel and ideally no signal should be observed. For each measurement the quadrupole mass filter was scanned over 4 Daltons in 0.5 seconds. As can be seen from FIG. 5B without a travelling DC potential wave applied to the collision cell 1 daughter ions having a mass to charge ratio of 195 were erroneously recorded as being present in the second (dummy) channel at 89% of the intensity that they were observed in the first channel. This is a false result as in fact no such signal should be observed.

When a travelling wave DC potential was applied with a master clock frequency of 130 kHz (see FIG. 5A) daughter ions having a mass to charge ratio of 195 were no longer erroneously observed in the second (dummy) channel. This illustrates that the collision cell according to the preferred embodiment can advantageously effectively remove any crosstalk between the two channels.

Figure 6A:
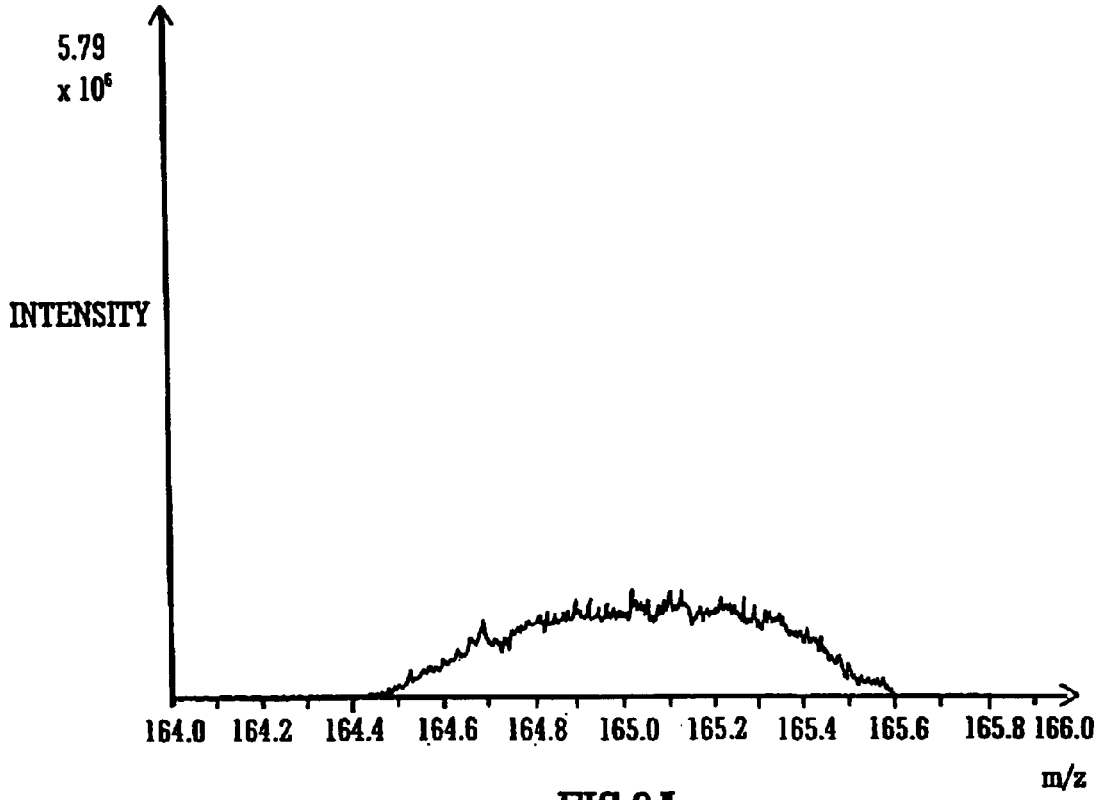
FIG. 6A shows a fragment ion peak obtained by the fragmentation of Verapamil using a conventional collision cell and FIG. 6B shows a comparable fragment ion peak obtained according to the preferred embodiment.
Figure 6B:
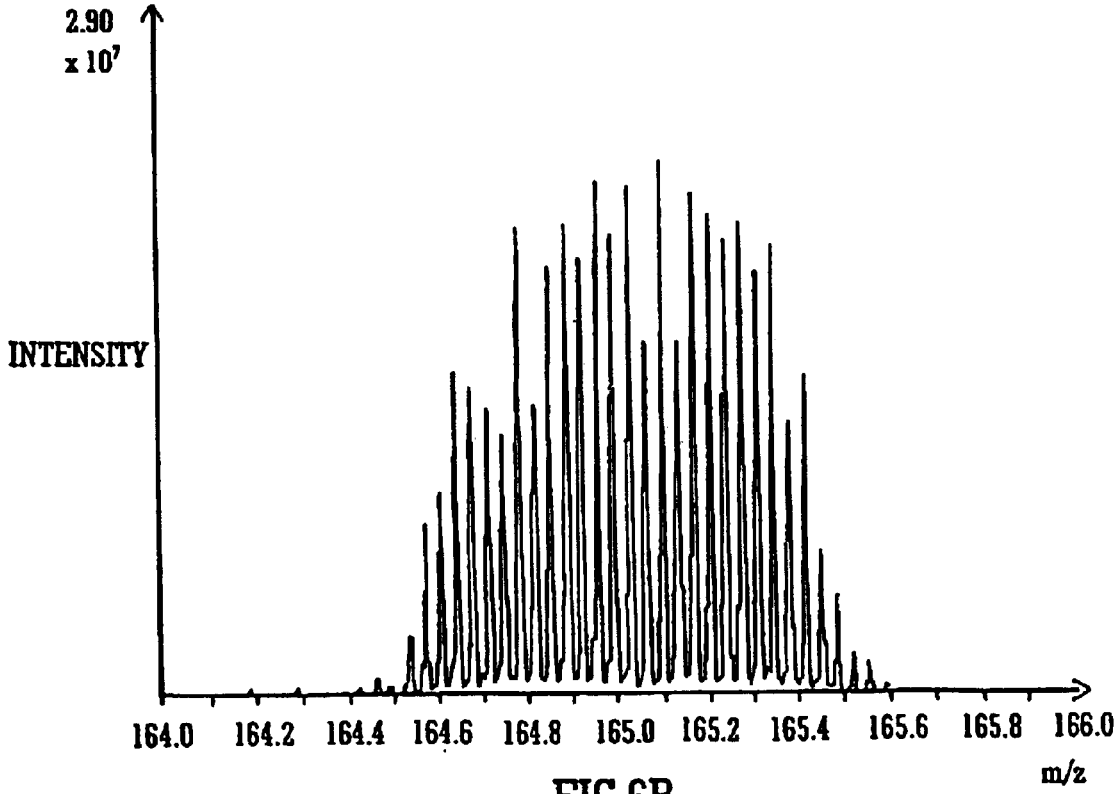

FIG. 6A shows a mass peak at mass to charge ratio 165 which was obtained conventionally without applying a travelling DC potential wave to the collision cell 1 and FIG. 6B shows a corresponding mass peak obtained according to the preferred embodiment when a travelling DC potential wave was applied to the collision cell 1. As can be readily seen from FIG. 6B, the detected signal when a repeating DC waveform was applied to the electrodes 2 of the collision cell 1 has a pulsed nature and this advantageously enables a phase lock amplifier to be used. The two mass spectra were taken at a scan speed of 20 Daltons per second and correspond to the most intense daughter ion of Verapamil. Verapamil parent ions have a mass of 455 daltons. The collision energy was set to be 29 eV and the travelling wave voltage, when applied, was 0.5 V and the travelling wave velocity was 11 m/s.

Figure 7:
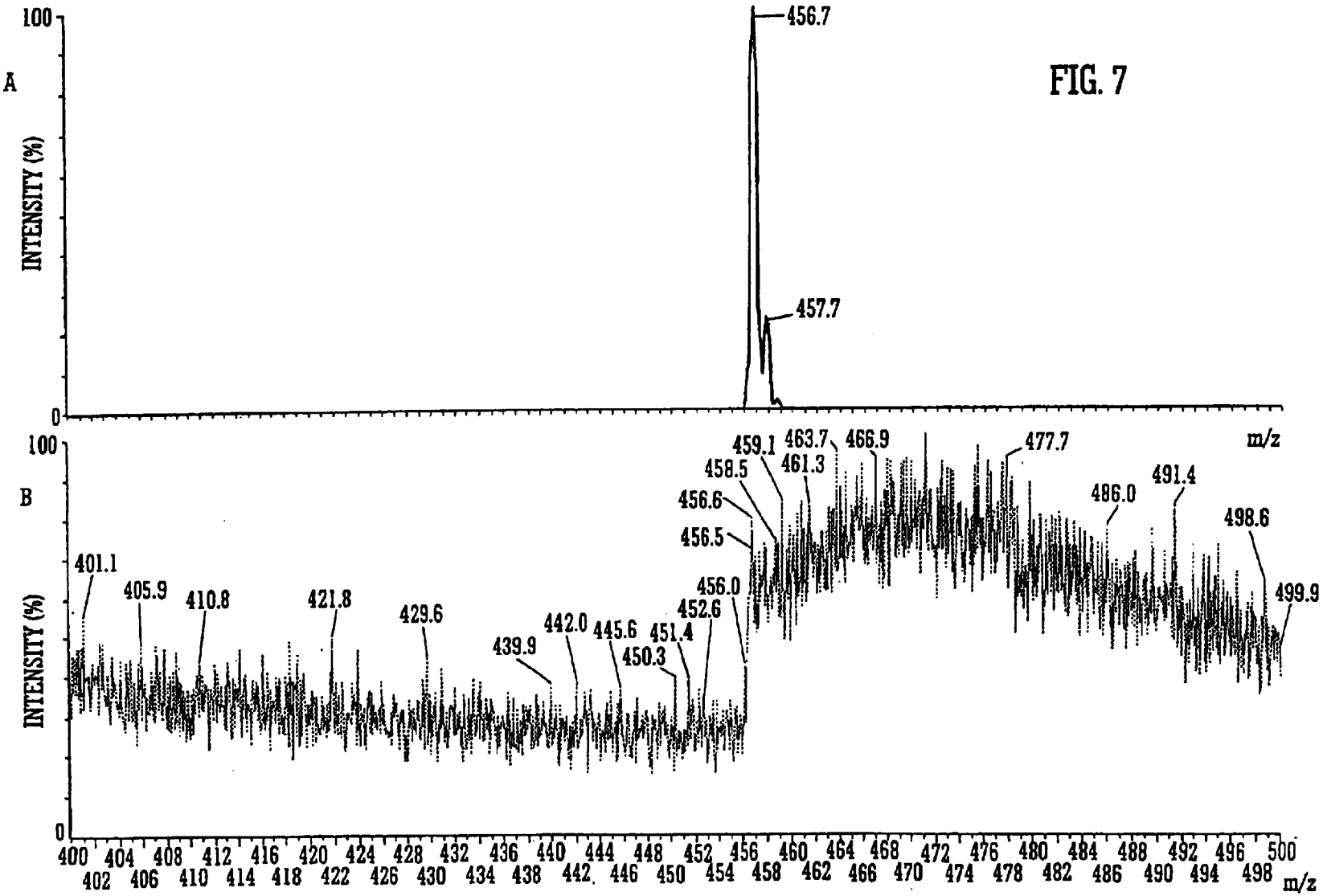
FIG. 7A shows a parent ion scan according to the preferred embodiment and FIG. 7B shows a comparable conventional parent ion scan.
Figure 8:
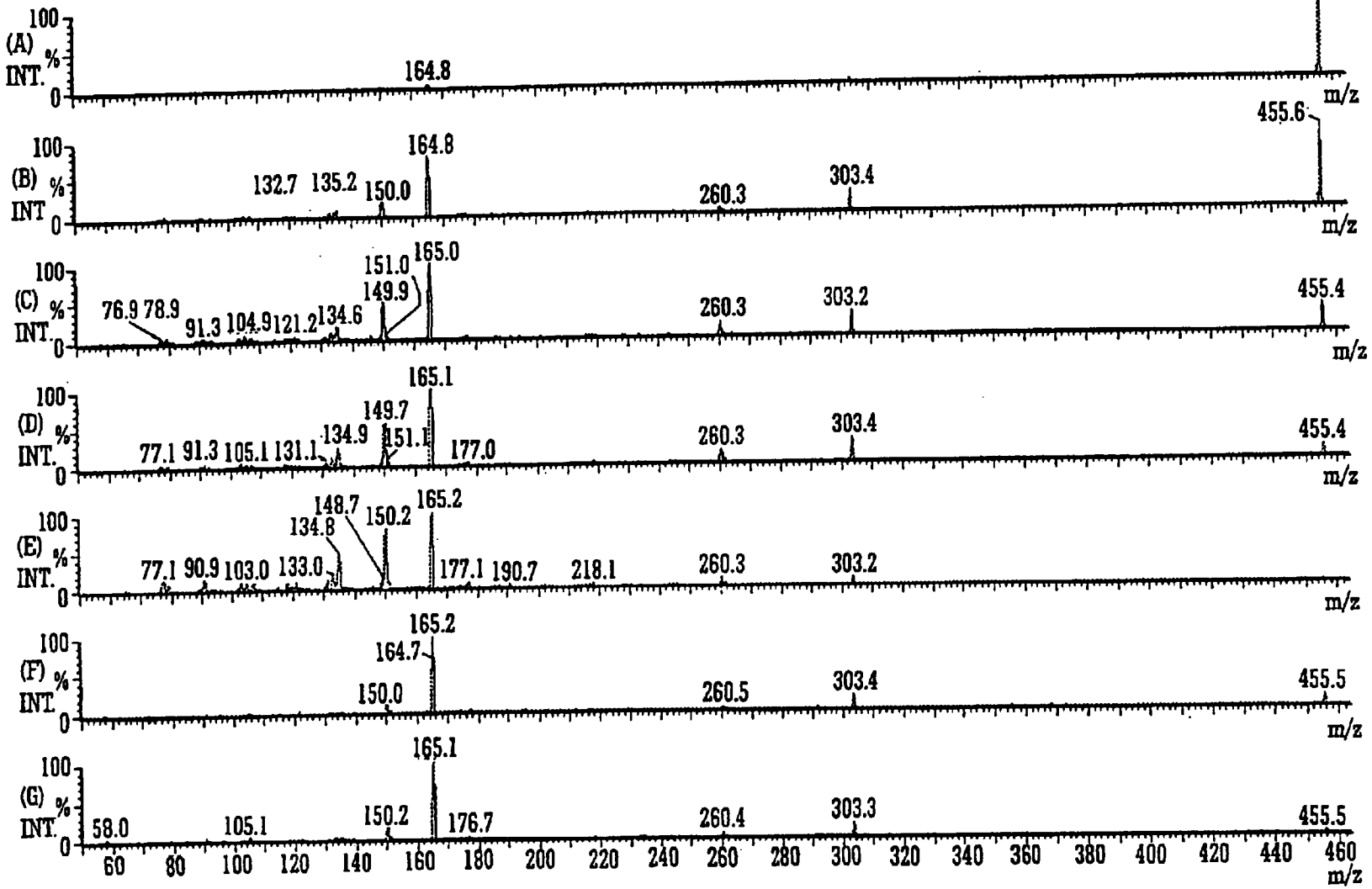
FIG. 8A shows a mass spectrum obtained when Verapamil parent ions having a mass to charge ratio of 455 entered a collision cell having a 150 m/s travelling DC potential waveform with a collision energy of 9 eV.
FIG. 8B shows a mass spectrum obtained when Verapamil parent ions entered a collision cell having a 150 m/s travelling DC potential waveform with a collision energy of 20 eV.
FIG. 8C shows a mass spectrum obtained when Verapamil parent ions entered a collision cell having a 150 m/s travelling DC potential waveform with a collision energy of 26 eV.
FIG. 8D shows a mass spectrum obtained when Verapamil parent ions entered a collision cell having a 150 m/s travelling potential waveform with a collision energy of 29 eV.
FIG. 8E shows a mass spectrum obtained when Verapamil parent ions entered a collision cell having a 150 m/s travelling DC potential waveform with a collision energy of 39 eV.
FIG. 8F shows a mass spectrum obtained when Verapamil parent ions entered a collision cell having a 1500 m/s travelling DC potential waveform according to the preferred embodiment with a collision energy of 2 eV and FIG. 8G shows a mass spectrum obtained when Verapamil parent ions entered a collision cell having a 1500 m/s travelling DC potential waveform according to the preferred embodiment with a collision energy of 10 eV.
Figure 9:
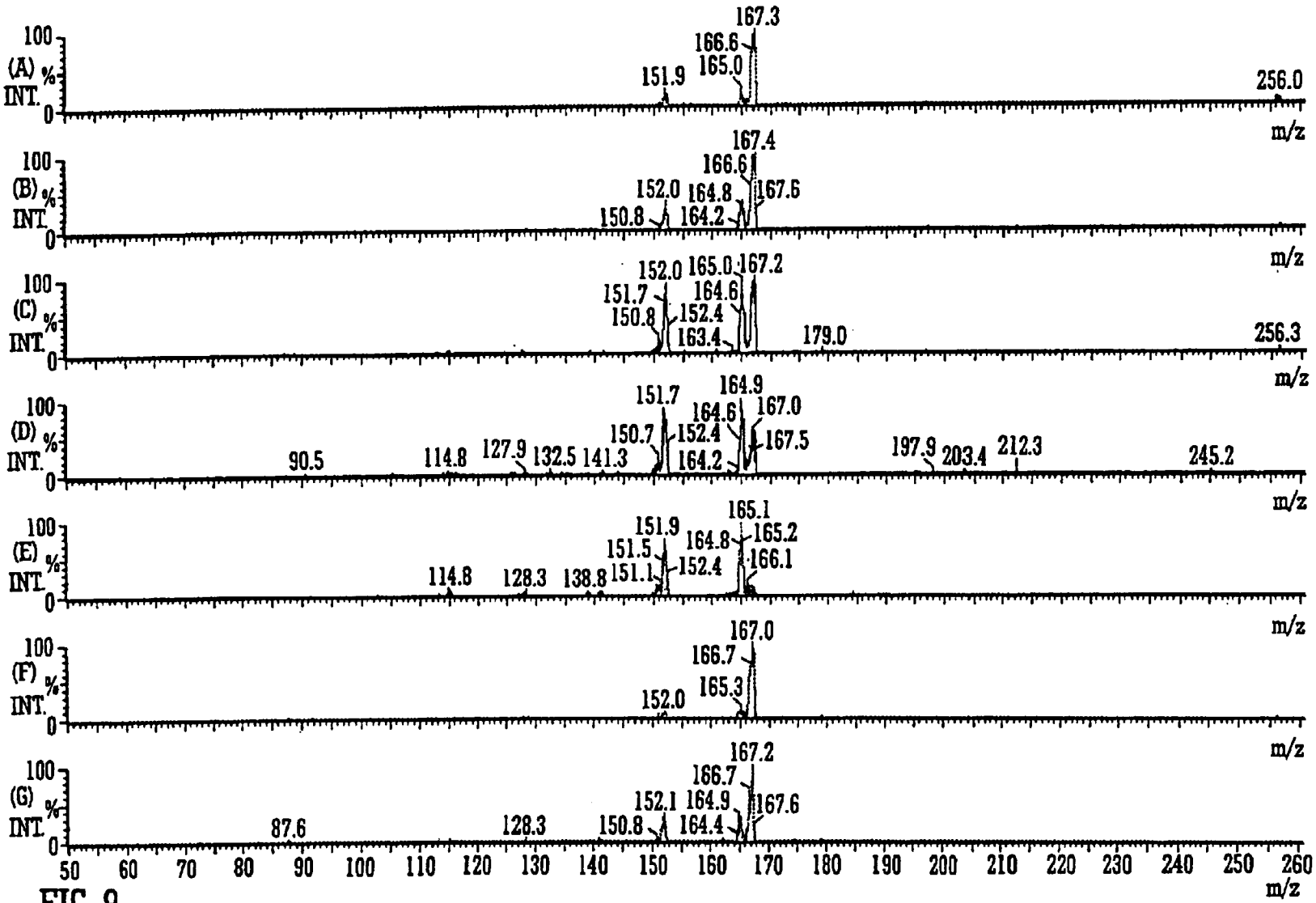
FIG. 9A shows a mass spectrum obtained when Diphenhydramine parent ions having a mass to charge ratio of 256 entered a collision cell having a 150 m/s travelling DC potential waveform with a collision energy of 9 eV.
FIG. 9B shows a mass spectrum-obtained when Diphenhydramine parent ions entered a collision cell having a 150 m/s travelling DC potential waveform with a collision energy of 20 eV.
FIG. 9C shows a mass spectrum obtained when Diphenhydramine parent ions entered a collision cell having a 150 m/s travelling DC potential waveform with a collision energy of 26 eV.
FIG. 9D shows a mass spectrum obtained when Diphenhydramine parent ions entered a collision cell having a 150 m/s travelling DC potential waveform with a collision energy of 29 eV.
FIG. 9E shows a mass spectrum obtained when Diphenhydramine parent ions entered a collision cell having a 150 m/s travelling DC potential waveform with a collision energy of 39 eV.
FIG. 9F shows a mass spectrum obtained when Diphenhydramine parent ions entered a collision cell having a 1500 m/s travelling DC potential waveform according to the preferred embodiment with a collision energy of 2 eV and FIG. 9G shows a mass spectrum obtained when Diphenhydramine parent ions entered a collision cell having a 1500 m/s travelling DC potential waveform according to the preferred embodiment with a collision energy of 10 eV.
Figure 10:
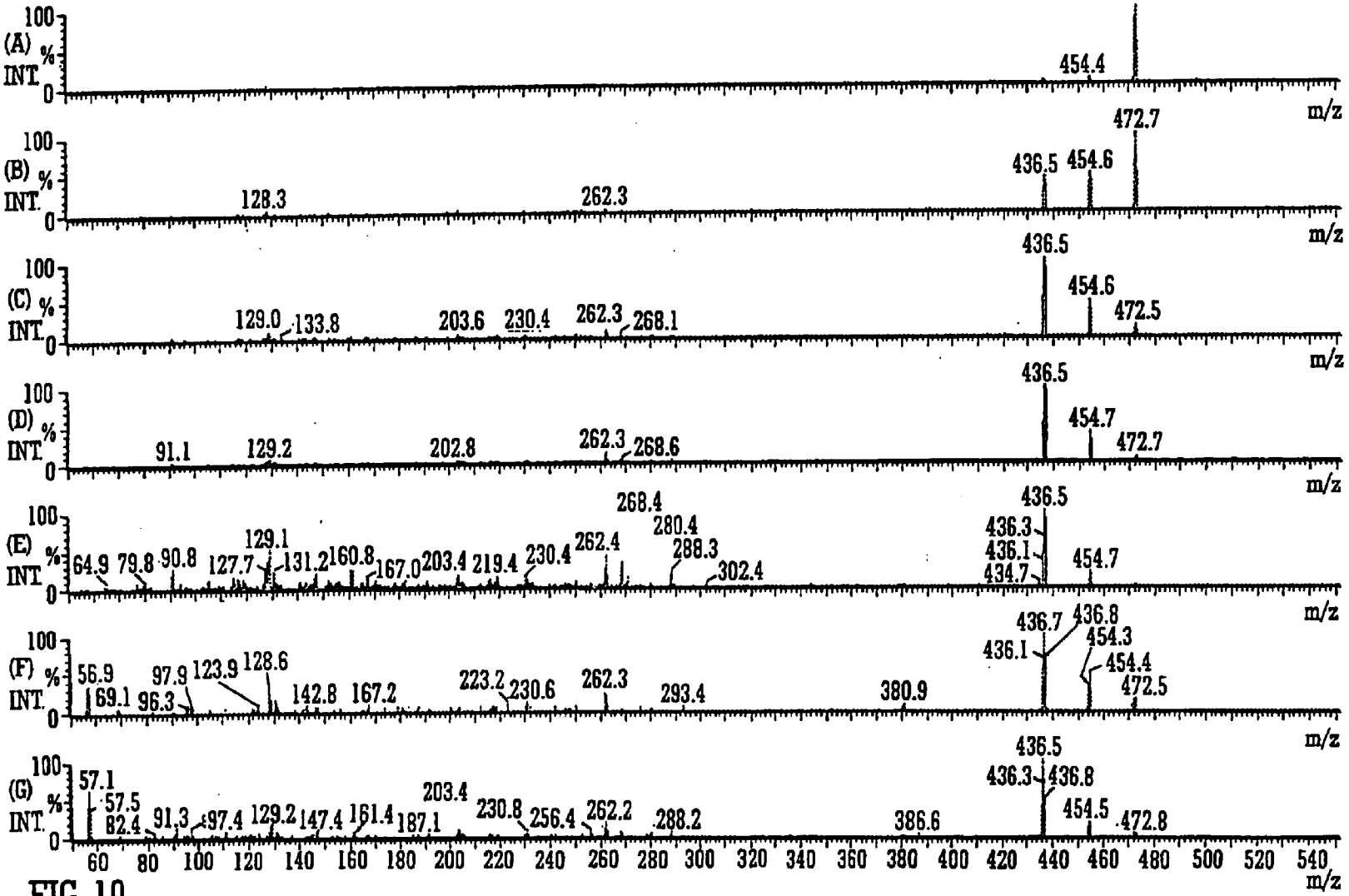
FIG. 10A shows a mass spectrum obtained when Terfenadine parent ions having a mass to charge ratio of 472 entered a collision cell having a 150 m/s travelling DC potential waveform with a collision energy of 9 eV.
FIG. 10B shows a mass spectrum obtained when Terfenadine parent ions entered a collision cell having a 150 m/s travelling DC potential waveform with a collision energy of 20 eV.
FIG. 10C shows a mass spectrum obtained when Terfenadine parent ions entered a collision cell having a 150 m/s travelling DC potential waveform with a collision energy of 26 eV.
FIG. 10D shows a mass spectrum obtained when Terfenadine parent ions entered a collision cell having a 150 m/s travelling DC potential waveform with a collision energy of 29 eV.
FIG. 10E shows a mass spectrum obtained when Terfenadine parent ions entered a collision cell having a 150 m/s travelling DC potential waveform with a collision energy of 39 eV.
FIG. 10F shows a mass spectrum obtained when Terfenadine parent ions entered a collision cell having a 1500 m/s travelling DC potential waveform according to the preferred embodiment with a collision energy of 2 eV and FIG. 10G shows a mass spectrum obtained when Terfenadine parent ions entered a collision cell having a 1500 m/s travelling DC potential waveform according to the preferred embodiment with a collision energy of 10 eV.
Figure 11:
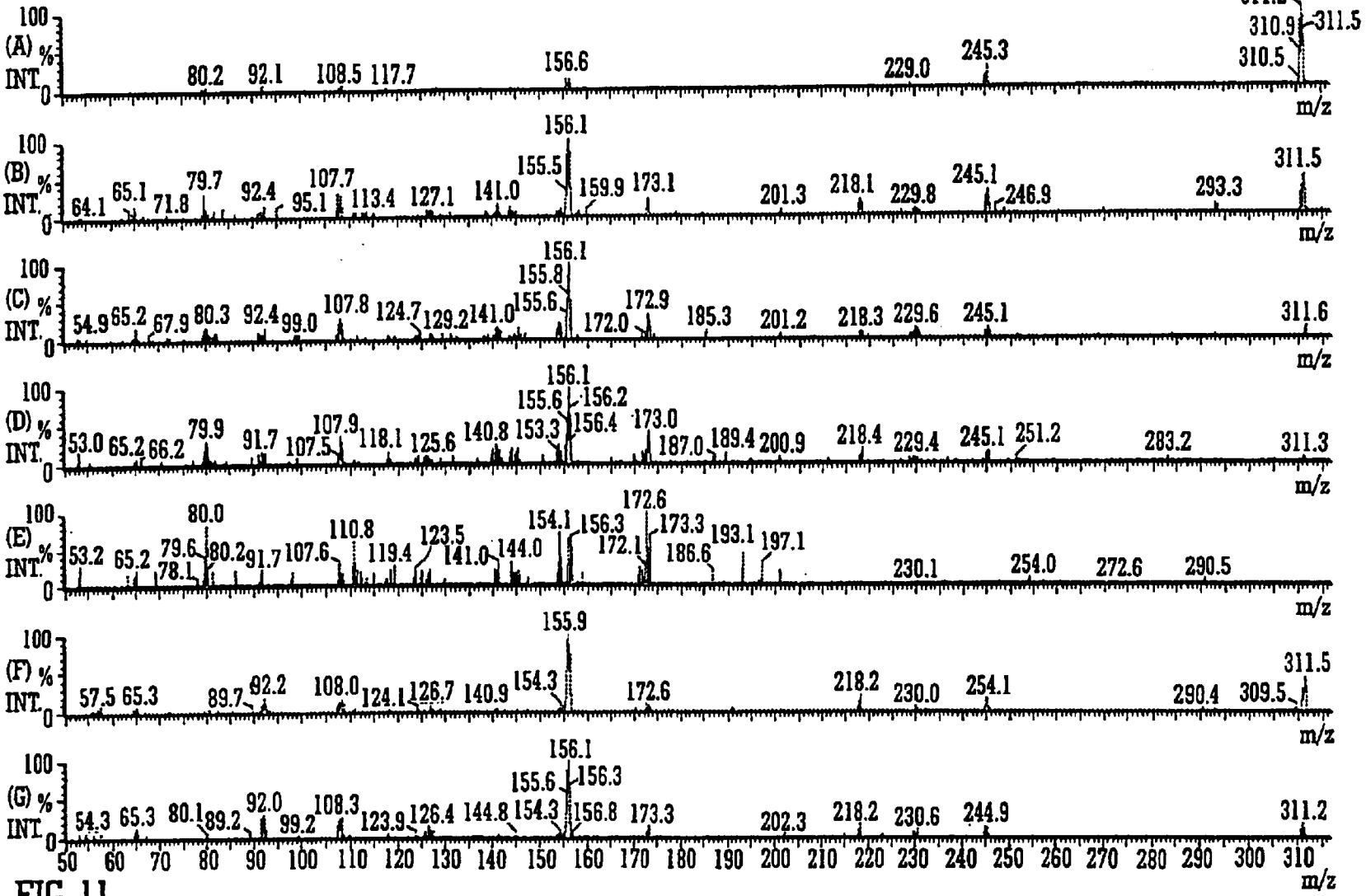
FIG. 11A shows a mass spectrum obtained when Sulfadimethoxine parent ions having a mass to charge ratio of 311 entered a collision cell having a 150 m/s travelling DC potential waveform with a collision energy of 9 eV.
FIG. 11B shows a mass spectrum obtained when Sulfadimethoxine parent ions entered a collision cell having a 150 m/s travelling DC potential waveform with a collision energy of 20 eV.
FIG. 11C shows a mass spectrum obtained when Sulfadimethoxine parent ions entered a collision cell having a 150 m/s travelling DC potential with a collision energy of 26 eV.
FIG. 11D shows a mass spectrum obtained when Sulfadimethoxine parent ions entered a collision cell having a 150 m/s travelling DC potential waveform with a collision energy of 29 eV.
FIG. 11E shows a mass spectrum obtained when Sulfadimethoxine parent ions entered a collision cell having a 150 m/s travelling DC potential waveform with a collision energy of 39 eV.
FIG. 11F shows a mass spectrum obtained when Sulfadimethoxine parent ions entered a collision cell having a 1500 m/s travelling DC potential waveform according to the preferred embodiment with a collision energy of 2 eV and FIG. 11G shows a mass spectrum obtained when Sulfadimethoxine parent ions entered a collision cell having a 1500 m/s travelling DC potential waveform according to the preferred embodiment with a collision energy of 10 eV.
Figure 12:
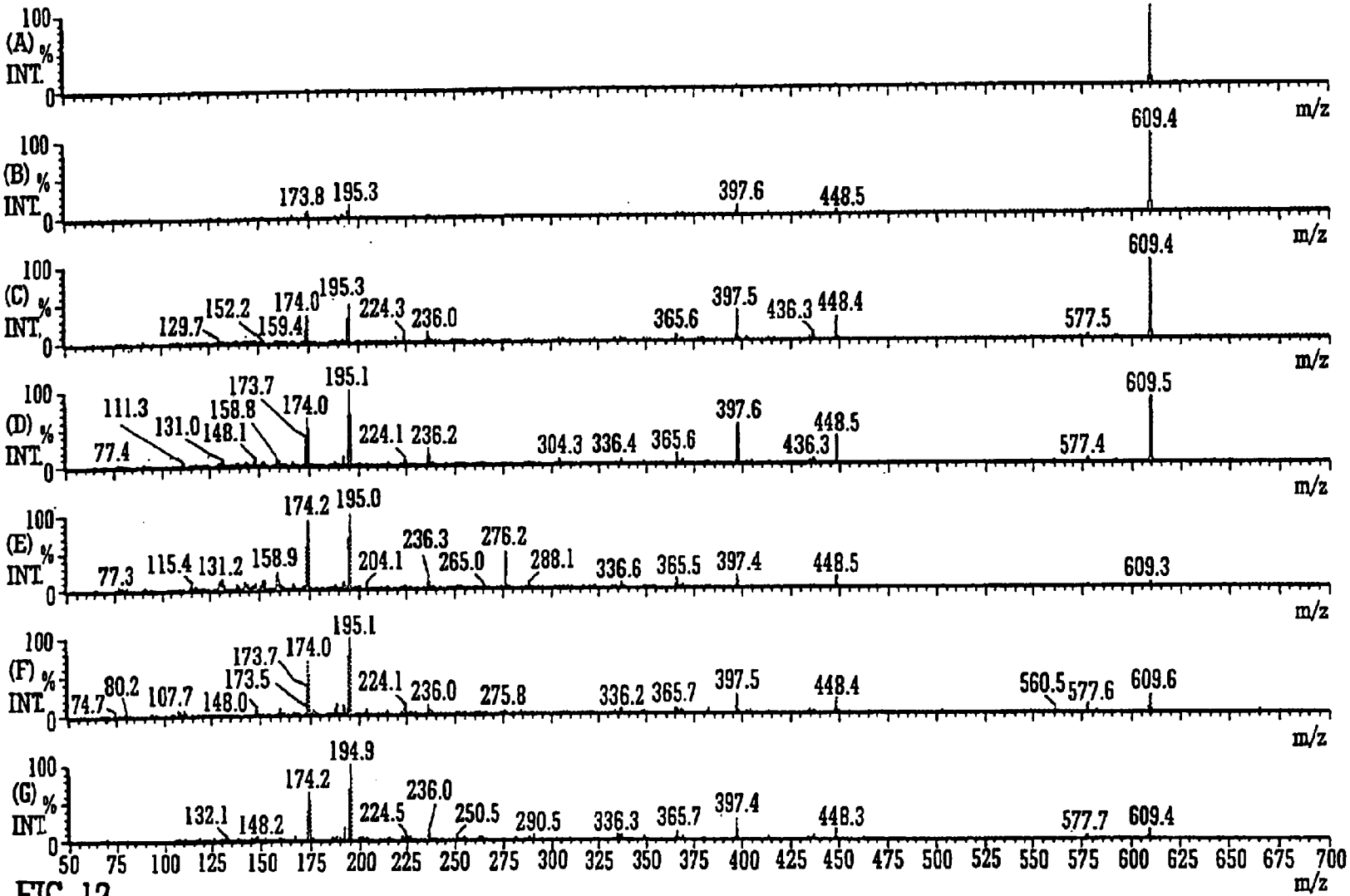
FIG. 12A shows a mass spectrum obtained when Reserpine parent ions having a mass to charge ratio of 609 entered a collision cell having a 150 m/s travelling DC potential waveform with a collision energy of 9 eV.
FIG. 12B shows a mass spectrum obtained when Reserpine parent ions entered a collision cell having a 150 m/s travelling DC potential waveform with a collision energy of 20 eV.
FIG. 12C shows a mass spectrum obtained when Reserpine parent ions entered a collision cell having a 150 m/s travelling DC potential waveform with a collision energy of 26 eV.
FIG. 12D shows a mass spectrum obtained when Reserpine parent ions entered a collision cell having a 150 m/s travelling DC potential waveform with a collision energy of 29 eV.
FIG. 12E shows a mass spectrum obtained when Reserpine parent ions entered a collision cell having a 150 m/s travelling DC potential waveform with a collision energy of 39 eV.
FIG. 12F shows a mass spectrum obtained when Reserpine parent ions entered a collision cell having a 1500 m/s travelling DC potential waveform according to the preferred embodiment with a collision energy of 2 eV and FIG. 12G shows a mass spectrum obtained when Reserpine parent ions entered a collision cell having a 1500 m/s travelling DC potential waveform according to the preferred embodiment with a collision energy of 10 eV.

FIGS. 7A and 7B show part of a parent ion scan of Verapamil with and without a travelling DC potential wave applied to the collision cell 1. The scanning speed was 1000 Daltons per second and when applied the travelling DC potential wave had a velocity of 300 n/s with a pulse voltage of 5 V. As can be readily seen from comparing FIG. 7A obtained according to the preferred embodiment with FIG. 7B obtained conventionally there is a significant improvement in the quality of the observed mass spectrum when a travelling DC potential wave was applied to the collision cell 1 according to the preferred embodiment.

FIGS. 8–12 show CID MS/MS data for different compounds at different collision energies with a travelling DC potential wave at two different travelling wave velocities (150 m/s and 1500 m/s). The mass spectra shown in FIGS. 8–12 were all obtained using a collision cell 1 comprised of a stack of 122 ring electrodes each 0.5 mm thick and spaced apart by 1.0 mm. The central aperture of each ring was 5.0 mm diameter and the total length of ring stack was 182 mm. A 2.75 MHz RF voltage was applied between neighbouring rings to radially confine the ion beam within the collision cell 1. The pressure in the collision cell 1 was approximately $3.4\times10^{-3}$ mbar. The travelling wave which was applied comprised a regular periodic pulse of constant amplitude and velocity. The travelling wave was generated by applying a transient DC voltage to a pair of ring electrodes and every subsequent ring pair displaced by seven ring pairs along the ring stack. In each ring pair one electrode was maintained at a positive phase of the RF voltage and the other the negative. One wavelength of the waveform therefore consisted of two rings with a raised (transient) DC potential followed by twelve rings held at lower (normal) potentials. Thus, the wavelength $\lambda$ was equivalent to 14 rings (21 mm) and the collision cell 1 therefore had a length equivalent to approximately 5.8 $\lambda$.

The travelling DC potential wave was generated by applying a transient 10 V voltage to each pair of ring electrodes for a given time t before moving the applied voltage to the next pair of ring electrodes. This sequence was repeated uniformly along the length of the collision cell 1. Thus the wave velocity $v_{wave}=\lambda t$ was equal to 3 mm/t where t is the time that the transient DC voltage was applied to an electrode.

The data shows that at relatively low travelling DC wave velocities (e.g. 150 m/s) the collision energy determines the nature of the MS/MS spectrum and optimises at different collision energies for different parent ion masses. However, at higher travelling DC wave velocities (e.g. 1500 m/s) relatively high collision energy is not required for some ions and a relatively fast travelling wave is sufficient to effectively fragment all parent ions irrespective of their mass.

FIGS. 8A–8G show fragmentation mass spectra obtained from Verapamil (m/z 455) using different collision energies and two different travelling DC wave velocities. The travelling DC wave velocity was 150 m/s for the mass spectra shown in FIGS. 8A–8E and 1500 m/s for the mass spectra shown in FIGS. 8F and 8G. The pulse voltage was 10V and the gas cell pressure was $3.4\times10^{-3}$ mbar. The collision energy was 9 eV for the mass spectrum shown in FIG. 8A, 20 eV for the mass spectrum shown in FIG. 8B, 26 eV for the mass spectrum shown in FIG. 5C, 29 eV for the mass spectrum shown in FIG. 8D, 39 eV for the mass spectrum shown in FIG. 5E, 2 eV for the mass spectrum shown in FIG. 8F and 10 eV for the mass spectrum shown in FIG. 8G.

FIGS. 9A–9G show fragmentation mass spectra obtained from Diphenhydramine (m/z 256) using different collision energies and two different travelling DC wave velocities. The travelling DC wave velocity was 150 m/s for the mass spectra shown in FIGS. 9A–9E and 1500 m/s for the mass spectra shown in FIGS. 9F and 9G. The pulse voltage was 10V and the gas cell pressure $3.4\times10^{-3}$ mbar. The collision energy was 9 eV for the mass spectrum shown in FIG. 9A, 20 eV for the mass spectrum shown in FIG. 9B, 26 eV for the mass spectrum shown in FIG. 9C, 29 eV for the mass spectrum shown in FIG. 9D, 39 eV for the mass spectrum shown in FIG. 9E, 2 eV for the mass spectrum shown in FIG. 9F and 10 eV for the mass spectrum shown in FIG. 9G. Diphenhydramine is unusual in that it fragments exceptionally easily. It is sometimes used as a test compound to show how gentle a source is.

FIGS. 10A–10G show fragmentation mass spectra obtained from Terfenadine (m/z 472) using different collision energies and two different travelling DC wave velocities. The travelling DC wave velocity was 150 m/s for the mass spectra shown in FIGS. 10A–10E and 1500 m/s for the mass spectra shown in FIGS. 10F and 10G. The pulse voltage was 10V and the gas cell pressure $3.4\times10^{-3}$ mbar. The collision energy was 9 eV for the mass spectrum shown in FIG. 10A, 20 eV for the mass spectrum shown in FIG. 10B, 26 eV for the mass spectrum shown in FIG. 10C, 29 eV for the mass spectrum shown in FIG. 10D, 39 eV for the mass spectrum shown in FIG. 10E, 2 eV for the mass spectrum shown in FIG. 10F and 10 eV for the mass spectrum shown in FIG. 10G.

FIGS. 11A–11G show fragmentation mass spectra obtained from Sulfadimethoxine (m/z 311) using different collision energies and two different travelling DC wave velocities. The travelling DC wave velocity was 150 m/s for the mass spectra shown in FIGS. 11A–11E and 1500 m/s for the mass spectra shown in FIGS. 11F and 11G. The pulse voltage was 10V and the gas cell pressure $3.4\times10^{-3}$ mbar. The collision energy was 9 eV for the mass spectrum shown in FIG. 11A, 20 eV for the mass spectrum shown in FIG. 11B, 26 eV for the mass spectrum shown in FIG. 11C, 29 eV for the mass spectrum shown in FIG. 11D, 39 eV for the mass spectrum shown in FIG. 11E, 2 eV for the mass spectrum shown in FIG. 11F and 10 eV for the mass spectrum shown in FIG. 11G.

Finally, FIGS. 12A–12G show fragmentation mass spectra obtained from Reserpine (m/z 609) using different collision energies and two different travelling DC wave velocities. The travelling DC wave velocity was 150 m/s for the mass spectra shown in FIGS. 12A–12E and 1500 m/s for the mass spectra shown in FIGS. 12F and 12G. The pulse voltage was 10V and the gas cell pressure $3.4\times10^{-3}$ mbar. The collision energy was 9 eV for the mass spectrum shown in FIG. 12A, 20 eV for the mass spectrum shown in FIG. 12B, 26 eV for the mass spectrum shown in FIG. 12C, 29 eV for the mass spectrum shown in FIG. 12D, 39 eV for the mass spectrum shown in FIG. 12E, 2 eV for the mass spectrum shown in FIG. 12F and 10 eV for the mass spectrum shown in FIG. 12G.

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

a fragmentation device comprising a plurality of electrodes wherein, in use, one or more transient DC voltages or one or more transient DC voltage waveforms are progressively applied to said electrodes so that ions are urged along said fragmentation device.

2. A mass spectrometer as claimed in claim 1, wherein in use an axial voltage gradient along at least a portion of the length of said fragmentation device varies with time whilst ions are being transmitted through said fragmentation device.

3. A mass spectrometer as claimed in claim 1, wherein said fragmentation device comprises at least a first electrode held at a first reference potential, a second electrode held at a second reference potential, and a third electrode held at a third reference potential, wherein:

at a first time $t_1$ a first DC voltage is supplied to said first electrode so that said first electrode is held at a first potential above or below said first reference potential;

at a second later time $t_2$ a second DC voltage is supplied to said second electrode so that said second electrode is held at a second potential above or below said second reference potential; and at a third later time $t_3$ a third DC voltage is supplied to said third electrode so that said third electrode is held at a third potential above or below said third reference potential.

4. A mass spectrometer as claimed in claim 3, wherein:

at said first time $t_1$ said second electrode is at said second reference potential and said third electrode is at said third reference potential;

at said second time $t_2$ said first electrode is at said first potential and said third electrode is at said third reference potential; and at said third time $t_3$ said first electrode is at said first potential and said second electrode is at said second potential.

5. A mass spectrometer as claimed in claim 3, wherein:

at said first time $t_1$ said second electrode is at said second reference potential and said third electrode is at said third reference potential;

at said second time $t_2$ said first electrode is no longer supplied with said first DC voltage so that said first electrode is returned to said first reference potential and said third electrode is at said third reference potential; and at said third time $t_3$ said second electrode is no longer supplied with said second DC voltage so that said second electrode is returned to said second reference potential and said first electrode is at said first reference potential.

6. A mass spectrometer as claimed in claim 3, wherein said first, second and third reference potentials are substantially the same.

7. A mass spectrometer as claimed in claim 3, wherein said first, second and third DC voltages are substantially the same.

8. A mass spectrometer as claimed in claim 3, wherein said first, second and third potentials are substantially the same.

9. A mass spectrometer as claimed in claim 1, wherein said fragmentation device comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential.

10. A mass spectrometer as claimed in claim 9, wherein a plurality of segments are maintained at substantially the same DC potential.

11. A mass spectrometer as claimed in claim 9, wherein each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

12. A mass spectrometer as claimed in claim 1, wherein ions are confined radially within said fragmentation device by an AC or RF electric field.

13. A mass spectrometer as claimed in claim 1, wherein ions are radially confined within said fragmentation device in a pseudo-potential well and are constrained axially by a real potential barrier or well.

14. A mass spectrometer as claimed in claim 1, wherein the transit time of ions through said fragmentation device is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

15. A mass spectrometer as claimed in claim 1, wherein at least 50%, 60%, 70%, 80%, 90% or 95% of the ions entering said fragmentation device are arranged to have, in use, an energy greater than or equal to 10 eV for a singly charged ion or greater than or equal to 20 eV for a doubly charged ion such that said ions are caused to fragment.

16. A mass spectrometer as claimed in claim 1, wherein at least 50%, 60%, 70%, 80%, 90% or 95% of the ions entering said fragmentation device are arranged to fragment upon colliding with collision gas within said fragmentation device.

17. A mass spectrometer as claimed in claim 1, wherein said fragmentation device is maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

18. A mass spectrometer as claimed in claim 1, wherein said fragmentation device is maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

19. A mass spectrometer as claimed in claim 1, wherein said fragmentation device is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

20. A mass spectrometer as claimed in claim 1, wherein said fragmentation device is maintained, in use, at a pressure such that a viscous drag is imposed upon ions passing through said fragmentation device.

21. A mass spectrometer as claimed in claim 1, wherein in use said one or more transient DC voltages or said one or more transient DC voltage waveforms are initially provided at a first axial position and are then subsequently provided at second, then third different axial positions along said fragmentation device.

22. A mass spectrometer as claimed in claim 1, wherein said one or more transient DC voltages or said one or more transient DC voltage waveforms move in use from one end of said fragmentation device to another end of said fragmentation device so that ions are urged along said fragmentation device.

23. A mass spectrometer as claimed in claim 1, wherein said one or more transient DC voltages create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

24. A mass spectrometer in claim 1, wherein said one or more transient DC voltage waveforms comprise a repeating waveform.

25. A mass spectrometer as claimed in claim 24, wherein said one or more transient DC voltage waveforms comprise a square wave.

26. A mass spectrometer as claimed in claim 1, wherein the amplitude of said one or more transient DC voltages or said one or more transient DC voltage waveforms remains substantially constant with time.

27. A mass spectrometer as claimed in claim 1, wherein the amplitude of said one or more transient DC voltages or said one or more transient DC voltage waveforms varies with time.

28. A mass spectrometer as claimed in claim 27, wherein the amplitude of said one or more transient DC voltages or said one or more transient DC voltage waveforms either: (i) increases with time; (ii) increases then decreases with time; (iii) decreases with time; or (iv) decreases then increases with time.

29. A mass spectrometer as claimed in claim 28, wherein said fragmentation device comprises an upstream entrance region, a downstream exit region and an intermediate region, wherein:

in said entrance region the amplitude of said one or more transient DC voltages or said one or more transient DC voltage waveforms has a first amplitude;

in said intermediate region the amplitude of said one or more transient DC voltages or said one or more transient DC voltage waveforms has a second amplitude; and in said exit region the amplitude of said one or more transient DC voltages or said one or more transient DC voltage waveforms has a third amplitude.

30. A mass spectrometer as claimed in claim 29, wherein the entrance and/or exit region comprise a proportion of the total axial length of said fragmentation device selected from the group consisting of: (i) <5%; (ii) 5–10%; (iii) 10–15%; (iv) 15–20%; (v) 20–25%; (vi) 25–30%; (vii) 30–35%; (viii) 35–40%; and (ix) 40–45%.

31. A mass spectrometer as claimed in claim 29, wherein said first and/or third amplitudes are substantially zero and said second amplitude is substantially non-zero.

32. A mass spectrometer as claimed in claim 29, wherein said second amplitude is larger than said first amplitude and/or said second amplitude is larger than said third amplitude.

33. A mass spectrometer as claimed in claim 1, wherein said one or more transient DC voltages or said one or more transient DC voltage waveforms pass in use along said fragmentation device with a first velocity.

34. A mass spectrometer as claimed in claim 33, wherein said first velocity: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

35. A mass spectrometer as claimed in claim 1, wherein said one or more transient DC voltages or said one or more transient DC voltage waveforms cause ions within said fragmentation device to pass along said fragmentation device with a second velocity.

36. A mass spectrometer as claimed in claim 35, wherein the difference between said first velocity and said second velocity is less than or equal to 100 m/s, 90 m/s, 80 m/s, 70 m/s, 60 m/s, 50 m/s, 40 m/s, 30 m/s, 20 m/s, 10 m/s, 5 m/s or 1 m/s.

37. A mass spectrometer as claimed in claim 33, wherein said first velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

38. A mass spectrometer as claimed in claim 35, wherein said second velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

39. A mass spectrometer as claimed in claim 35, wherein said second velocity is substantially the same as said first velocity.

40. A mass spectrometer as claimed in claim 1, wherein said one or more transient DC voltages or said one or more transient DC voltage waveforms has a frequency, and wherein said frequency: (i) remains substantially constant; (ii) varies; (iii) increases; (iv) increases then decreases; (v) decreases; or (vi) decreases then increases.

41. A mass spectrometer as claimed in claim 1, wherein said one or more transient DC voltages or said one or more transient DC voltage waveforms has a wavelength, and wherein said wavelength: (i) remains substantially constant; (ii) varies; (iii) increases; (iv) increases then decreases; (v) decreases; or (vi) decreases then increases.

42. A mass spectrometer as claimed in claim 1, wherein two or more transient DC voltages or two or more transient DC waveforms are arranged to pass simultaneously along said fragmentation device.

43. A mass spectrometer as claimed in claim 42, wherein said two or more transient DC voltages or said two or more transient DC waveforms are arranged to move: (i) in the same direction; (ii) in opposite directions; (iii) towards each other; (iv) away from each other.

44. A mass spectrometer as claimed in claim 1, wherein said one or more transient DC voltages or said one or more transient DC waveforms are repeatedly generated and passed in use along said fragmentation device, and wherein the frequency of generating said one or more transient DC voltages or said one or more transient DC voltage waveforms: (i) remains substantially constant; (ii) varies; (iii) increases; (iv) increases then decreases; (v) decreases; or (vi) decreases then increases.

45. A mass spectrometer as claimed in claim 1, wherein in use a continuous beam of ions is received at an entrance to said fragmentation device.

46. A mass spectrometer as claimed in claim 1, wherein in use packets of ions are received at an entrance to said fragmentation device.

47. A mass spectrometer as claimed in claim 1, wherein in use pulses of ions emerge from an exit of said fragmentation device.

48. A mass spectrometer as claimed in claim 47, further comprising an ion detector, said ion detector being arranged to be substantially phase locked in use with the pulses of ions emerging from the exit of the fragmentation device.

49. A mass spectrometer as claimed in claim 47, further comprising a Time of Flight mass analyser comprising an electrode for injecting ions into a drift region, said electrode being arranged to be energised in use in a substantially synchronised manner with the pulses of ions emerging from the exit of the fragmentation device.

50. A mass spectrometer as claimed in claim 1, wherein said fragmentation device is selected from the group consisting of: (i) an ion funnel comprising a plurality of electrodes having apertures therein through which ions are transmitted, wherein the diameter of said apertures becomes progressively smaller or larger; (ii) an ion tunnel comprising a plurality of electrodes having apertures therein through which ions are transmitted, wherein the diameter of said apertures remains substantially constant; and (iii) a stack of plate, ring or wire loop electrodes.

51. A mass spectrometer as claimed in claim 1, wherein said fragmentation device comprises a plurality of electrodes, each electrode having an aperture through which ions are transmitted in use.

52. A mass spectrometer as claimed in claim 1, wherein each electrode has a substantially circular aperture.

53. A mass spectrometer as claimed in claim 1, wherein each electrode has a single aperture through which ions are transmitted in use.

54. A mass spectrometer as claimed in claim 51, wherein the diameter of the apertures of at least 50%, 60%, 70%, 80%, 90% or 95% of the electrodes forming said fragmentation device is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

55. A mass spectrometer as claimed in claim 1, wherein at least 50%, 60%, 70%, 80%, 90% or 95% of the electrodes forming the fragmentation device have apertures which are substantially the same size or area.

56. A mass spectrometer as claimed in claim 1, wherein said fragmentation device comprises a segmented rod set.

57. A mass spectrometer as claimed in claim 1, wherein said fragmentation device is selected from the group consisting of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

58. A mass spectrometer as claimed in claim 1, wherein the thickness of at least 50%, 60%, 70%, 80%, 90% or 95% of said electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

59. A mass spectrometer as claimed in claim 1, wherein said fragmentation device has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

60. A mass spectrometer as claimed in claim 1, wherein said fragmentation device comprises a housing having an upstream opening for allowing ions to enter said fragmentation device and a downstream opening for allowing ions to exit said fragmentation device.

61. A mass spectrometer as claimed in claim 60, wherein the fragmentation device further comprises an inlet port through which a collision gas is introduced.

62. A mass spectrometer as claimed in claim 61, wherein said collision gas comprises air and/or one or more inert gases and/or one or more non-inert gases.

63. A mass spectrometer as claimed in claim 1, wherein at least 10%, 20%, 30%, 40%, 50%, 60%, 70%, 80%, 90%, or 95% of said electrodes are connected to both a DC and an AC or RF voltage supply.

64. A mass spectrometer as claimed in claim 1, wherein axially adjacent electrodes are supplied with AC or RF voltages having a phase difference of 180°.

65. A mass spectrometer as claimed in claim 1, further comprising an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI") ion source; (viii) Chemical Ionisation ("CI") ion source; (ix) a Fast Atom Bombardment ("FAB") ion source; and (x) a Liquid Secondary Ions Mass Spectrometry ("LSIMS") ion source.

66. A mass spectrometer as claimed in claim 1, further comprising a continuous ion source.

67. A mass spectrometer as claimed in claim 1, further comprising a pulsed ion source.

68. A mass spectrometer comprising:

a reaction cell wherein in use ions react and/or exchange charge with a gas in said reaction cell, said reaction cell comprising a plurality of electrodes wherein, in use, one or more transient DC voltages or one or more transient DC voltage waveforms are progressively applied to said electrodes so that ions are urged along said reaction cell.

69. A mass spectrometer comprising:

a cell comprising a gas for damping, collisionally cooling, decelerating, axially focusing or otherwise thermalizing ions without substantially fragmenting said ions, said cell comprising a plurality of electrodes wherein, in use, one or more transient DC voltages or one or more transient DC voltage waveforms are progressively applied to said electrodes so that ions are urged along said cell.

70. A mass spectrometer comprising:

an ion source;

a mass filter;

a fragmentation device comprising a plurality of electrodes wherein, in use, one or more transient DC voltages or one or more transient DC voltage waveforms are progressively applied to said electrodes so that ions are urged along said fragmentation device; and a mass analyser.

71. A mass spectrometer as claimed in claim 70, further comprising an ion guide arranged upstream of said mass filter.

72. A mass spectrometer as claimed in claim 71, wherein said ion guide comprises a plurality of electrodes wherein at least some of said electrodes are connected to both a DC and an AC or RF voltage supply and wherein one or more transient DC voltages or one or more transient DC voltage waveforms are passed in use along at least a portion of the length of said ion guide to urge ions along said portion of the length of said ion guide.

73. A mass spectrometer as claimed in claim 70, wherein said mass filter comprises a quadrupole mass filter.

74. A mass spectrometer as claimed in claim 70, wherein said mass analyser comprises a Time of Flight mass analyser, a quadrupole mass analyser, a Fourier Transform Ion Cyclotron Resonance ("FTICR") mass analyser, a 2D (linear) quadrupole ion trap or a 3D (Paul) quadrupole ion trap.

75. A mass spectrometer comprising:

a fragmentation device comprising a plurality of electrodes having apertures, wherein ions are radially confined within said fragmentation device by an AC or RF voltage such that adjacent electrodes have a phase difference of 180°, and wherein one or more DC voltage pulses or one or more transient DC voltage waveforms are applied successively to a plurality of said electrodes so that ions are urged towards an exit of said fragmentation device and have a transit time of less than 20 ms through said fragmentation device.

76. A mass spectrometer comprising a fragmentation device having a plurality of electrodes wherein one or more DC voltage pulses or one or more transient DC voltage waveforms are applied to successive electrodes.

77. A method of mass spectrometry comprising:

providing a fragmentation device comprising a plurality of electrodes; and progressively applying one or more transient DC voltages or one or more transient DC voltage waveforms to said electrodes so that ions are fragmented within said fragmentation device and are urged along said fragmentation device.

78. A method as claimed in claim 77, wherein said step of progressively applying one or more transient DC voltages or one or more transient DC voltage waveforms comprises maintaining an axial voltage gradient which varies with time whilst ions are being transmitted through said fragmentation device.

79. A method as claimed in claim 77, wherein said one or more transient DC voltages or said one or more transient DC voltage waveforms are passed along said fragmentation device with a first velocity.

80. A method as claimed in claim 79, wherein said first velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; (xii) 2750–3000 m/s; (xiii) 3000–3250 m/s; (xiv) 3250–3500 m/s; (xv) 3500–3750 m/s; (xvi) 3750–4000 m/s; (xvii) 4000–4250 m/s; (xviii) 4250–4500 m/s; (xix) 4500–4750 m/s; (xx) 4750–5000 m/s; and (xxi) >5000 m/s.

81. A method of reacting ions and/or exchanging the charge of ions with a gas comprising:

providing a reaction cell comprising a plurality of electrodes; and progressively applying one or more transient DC voltages or one or more transient DC voltage waveforms to said electrodes so that ions are urged along said reaction cell.

82. A method of damping, collisionally cooling, decelerating, axially focusing or otherwise thermalizing ions without substantially fragmenting said ions comprising:

providing a cell comprising a plurality of electrodes; and progressively applying one or more transient DC voltages to said electrodes so that ions are urged along said cell.

* * * * *